US005540871A

United States Patent [19]

Uchida et al.

[11] Patent Number: 5,540,871

[45] Date of Patent: Jul. 30, 1996

[54] METHOD OF PRODUCING PATTERNED SHAPED ARTICLE FROM PARTICLES

[75] Inventors: Hiroshi Uchida, Ashikaga; Mituhiro Onuki, Kiryu; Hideo Watanabe, Ashikaga, all of Japan

[73] Assignee: CCA Inc., Tokyo, Japan

[21] Appl. No.: 360,440

[22] Filed: Dec. 21, 1994

[30] Foreign Application Priority Data

Dec. 21, 1993 [JP] Japan ..... 5-344766

[51] Int. Cl.[6] ..... B27N 3/02; B28B 1/28

[52] U.S. Cl. ..... 264/113; 264/101; 264/139; 264/241; 264/DIG. 31; 264/510; 428/143

[58] Field of Search ..... 264/101, 112, 264/113, 125, 135, 139, 154, 162, 239, 241, 245, 571, DIG. 31, 510; 156/154; 428/143, 147, 156

[56] References Cited

U.S. PATENT DOCUMENTS

| | | | |
|---|---|---|---|
| 3,941,636 | 3/1976 | Drout et al. | 264/126 |
| 5,368,791 | 11/1994 | Uchida et al. | 264/125 |

FOREIGN PATENT DOCUMENTS

| | | |
|---|---|---|
| 0558247 | 9/1993 | European Pat. Off. . |
| 0586257 | 3/1994 | European Pat. Off. . |
| 0611639 | 8/1994 | European Pat. Off. . |
| 2215266 | 9/1989 | United Kingdom . |

*Primary Examiner*—Robert A. Dawson
*Assistant Examiner*—Kenneth M. Jones
*Attorney, Agent, or Firm*—Oblon, Spivak, McClelland, Spivak, & Neustadt

[57] ABSTRACT

A method of producing a pattern shaped article includes the steps of forming at least two different courses of dry particles overlaid on a base surface; using an air flow controller having either a suction port or a blow port or both a suction port and a blow port to effect an air flow to form a cavity corresponding to a pattern expression in at least a lower dry particle course by removing a portion of the lower dry particle course under control of at least one parameter among air pressure, air flow rate, air flow speed, air flow direction, air flow pulsation, air flow intermittence, suction port size, blow port size, suction port position and blow port position; collapsing particles of an upper dry particle course of a different type of dry particles into the cavity and allowing the particles to set into an integral mass.

8 Claims, 30 Drawing Sheets

METHOD OF PRODUCING PATTERNED SHAPED ARTICLE FROM PARTICLES

BACKGROUND OF THE INVENTION

1. Field of the Invention

This invention relates to a method of producing patterned shaped articles, more particularly to such a method for producing patterned concrete shaped articles, patterned artificial stone shaped articles, patterned raw products for sintering into ceramic shaped articles, patterned ceramic shaped articles, patterned metal shaped articles, patterned impasto shaped articles, patterned plastic shaped articles, patterned shaped foodstuffs and the like, using an air flow controller.

2. Description of the Prior Art

Up to now the only way available for providing a part of a surface, such as of paving blocks, with a pattern indicating a pedestrian crossing, a stop sign or other such traffic sign or for providing the entire surface of the blocks with a pattern has been to paint the surface with a coating material such as paint or to inlay the desired pattern.

Since the patterns painted on a part or all of the surface of paving blocks are exposed to abrasion such as from the footwear of pedestrians walking on the blocks, and the tires of vehicles driving over them, they quickly wear off and have to be redone at frequent intervals. The amount of labor involved in this work is considerable. Where the pattern is formed by inlaying, the work itself is troublesome and very costly.

The present inventors previously proposed a method and an apparatus for producing various types of patterned shaped articles with surface patterns formed by pattern courses of prescribed thickness, by using an air flow controller and computer control (U.S. patent application Ser. No. 293,964 corresponding to Japanese Patent Application No. 5-229643).

The present invention is an improvement on the above method, and has as its object a method for producing, readily and at high speed, shaped articles having complex and highly sophisticated patterns of a prescribed thickness.

SUMMARY OF THE INVENTION

For attaining this object, the invention provides a method of producing a patterned shaped article comprising the steps of forming at least two different courses of dry particles overlaid on a base surface; using an air flow controller having either a suction port or a blow port or both a suction port and a blow port to effect an air flow to form a cavity corresponding to a pattern expression in at least a lower dry particle course by removing a portion of the lower dry particle course under control of at least one parameter among air pressure, air flow rate, air flow speed, air flow direction, air flow pulsation, air flow intermittence, suction port size, blow port size, suction port position and blow port position; collapsing particles of an upper dry particle course or a different type of dry particles into the cavity and setting the particles into an integral mass, either as they are or after being smoothed or after being overlaid with a backing course. Thus, the method of producing a patterned shaped article according to the invention comprises forming at least two different courses of dry particles on a base surface and using an air flow controller equipped with a suction port and/or blow port, whereby it becomes readily possible to express a complex pattern such as a photographed image in the form of dots or lines without using special members. In addition, since the material of the portion corresponding to the background and the material of the portion corresponding to the pattern are both formed on the base surface in advance, materials do not have to be supplied for individual patterns, so productivity is greatly enhanced.

The above and other objects, characteristic features and advantages of this invention will become apparent to those skilled in the art from the description of the invention given hereinbelow with reference to the accompanying drawings.

BRIEF DESCRIPTION OF THE DRAWINGS

FIG. 2(*b*) is a sectional view showing the composite course with a partial upper course.

FIG. 2(*c*) is a perspective view showing a first example of a suction port.

FIG. 2(*d*) is a perspective view showing a second example of a suction port.

FIG. 6(*b*) is a perspective view showing a third example of a suction port.

FIG. 6(*c*) is a perspective view showing a fourth example of a suction port.

FIGS. 7(*b*) and 7(*c*) illustrate the formation of a blue line pattern using the suction port of FIG. 7(*a*).

FIGS. 8(*b*) and 8(*c*) illustrate the formation of a red line pattern using the suction port of FIG. 8(*a*).

FIGS. 9(*b*) and 9(*c*) illustrate the formation of a blue pattern using the suction portion of FIG. 9(*a*).

FIGS. 10(*b*) and 10(*c*) illustrate the formation of a blue pattern using the suction port of FIG. 10(*a*).

FIG. 14(*b*) is a perspective view showing a first example of a blow port.

FIG. 14(*c*) is a perspective view showing a second example of a blow port.

FIG. 19(*b*) is a perspective view showing a second example of a form with a perforated base surface (bottom plate ).

FIG. 24(*b*) is a sectional view of the blow port of FIG. 24(*a*).

FIG. 27(*b*) is a perspective view showing a first example of an air flow controller in which the suction port and blow port are a single assembly.

FIG. 27(*c*) is a perspective view showing a second example of an air flow controller in which the suction port and blow port are a single assembly.

FIGS. 35(*b*) is a plan view of the shaped article of FIG. 35(*a*).

FIG. 35(*c*) is a perspective view of an apparatus utilizing particle suction and blowing to form the pattern on the shaped article of FIG. 35(*a*).

FIG. 39(*b*) is a perspective view of an air flow controller used to form a pattern on the shaped article of FIG. 39(*a*).

FIG. 41(*b*) is a perspective view showing a second example of a suction port (blow port).

FIG. 41(*c*) is a perspective view showing a third example of a suction port (blow port).

FIG. 43(*b*) is a perspective view showing multiple suction ports (blow ports) arranged in a matrix.

DESCRIPTION OF THE PREFERRED EMBODIMENTS

Figure 1:
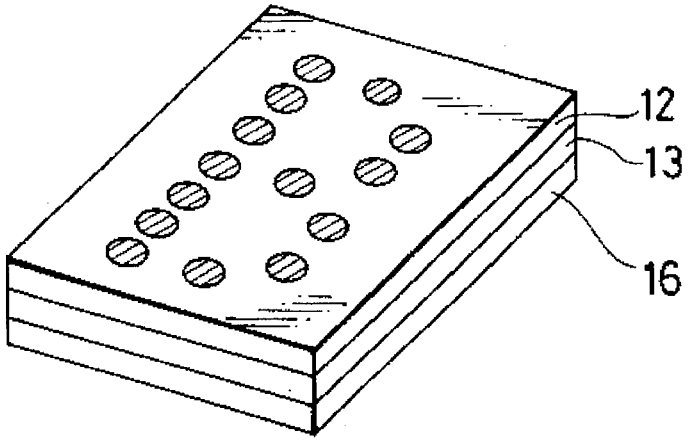
FIG. 1 is a perspective view showing a first example of a shaped article produced according to the invention.
Figure 2A:
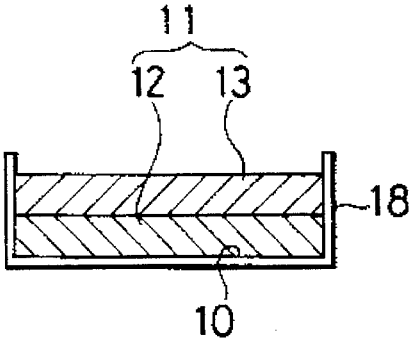
FIG. 2(*a*) is a sectional view showing the composite particle course.
Figure 2B:
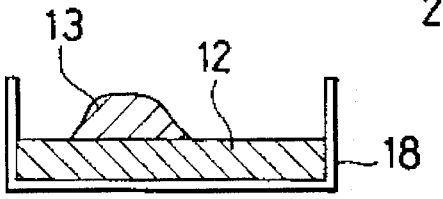
Figure 2C:
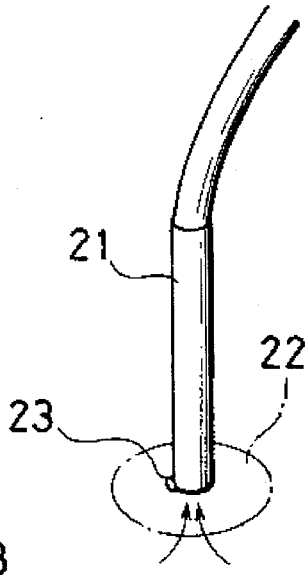
Figure 2D:
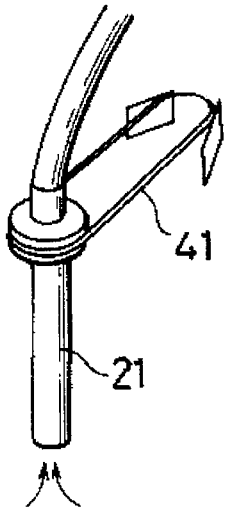
Figure 3A:
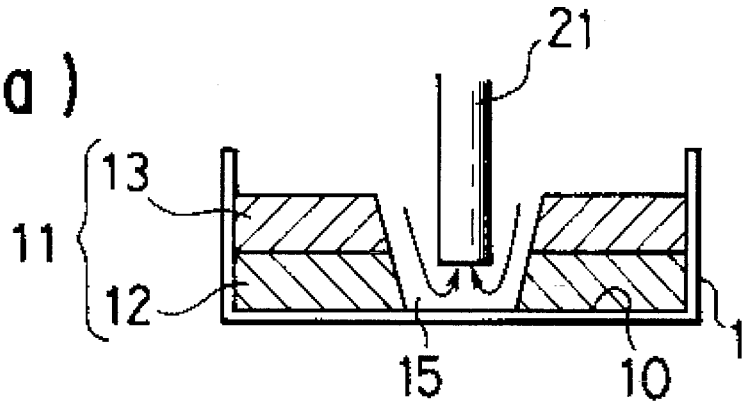
FIGS. 3(*a*) to 3(*d*) are sectional views showing a first sequence used to form a dot pattern on a shaped article.
Figure 3B:
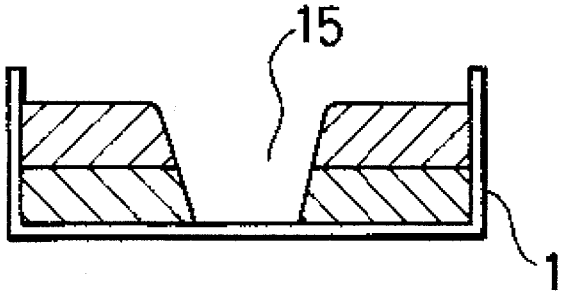
Figure 3C:
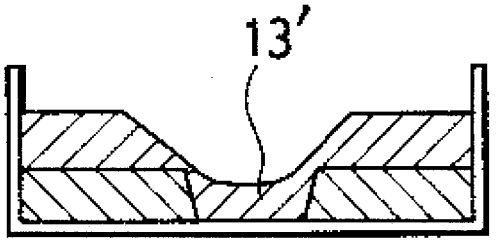
Figure 3D:
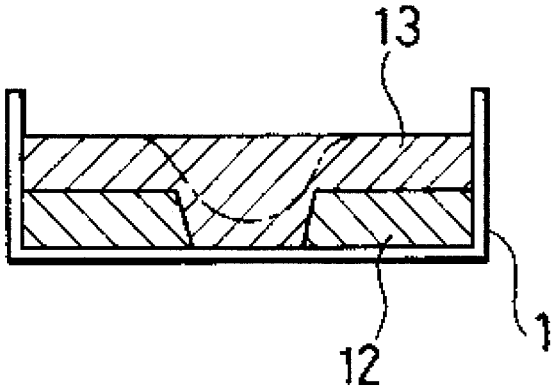
Figure 4A:
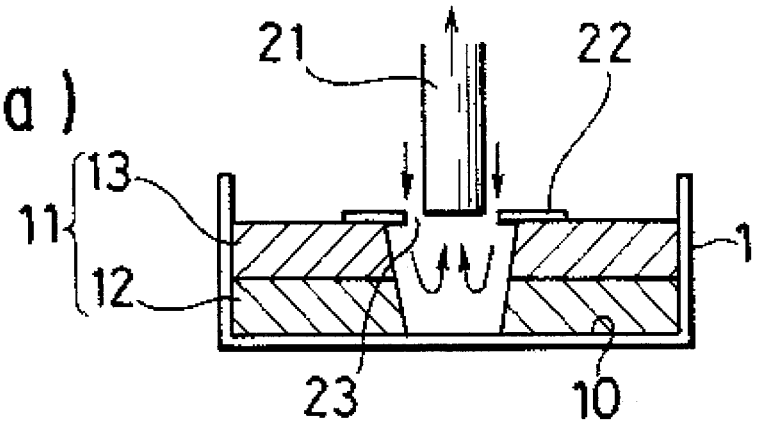
FIGS. 4(*a*) to 4(*d*) are sectional views showing a second sequence used to form a dot pattern on a shaped article.
Figure 4B:
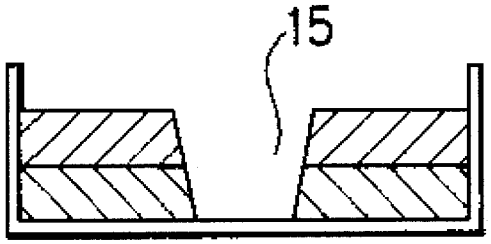
Figure 4C:
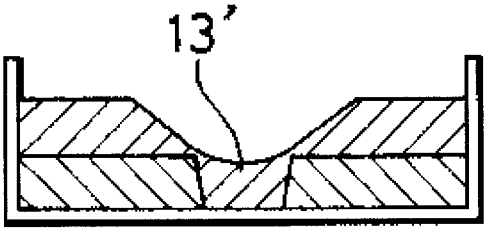
Figure 4D:
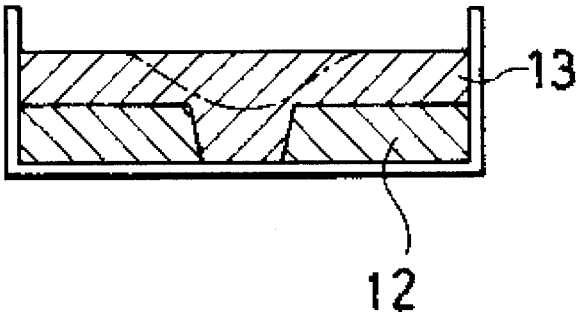
Figure 5A:
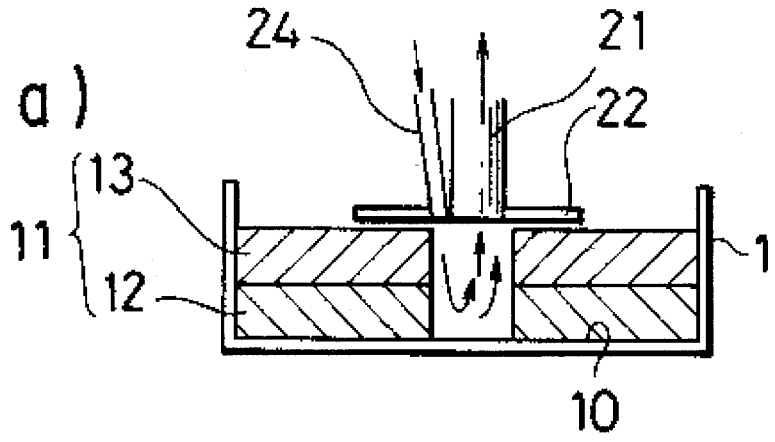
FIGS. 5(*a*) to 5(*d*) are sectional views showing a third sequence used to form a dot pattern on a shaped article.
Figure 5B:
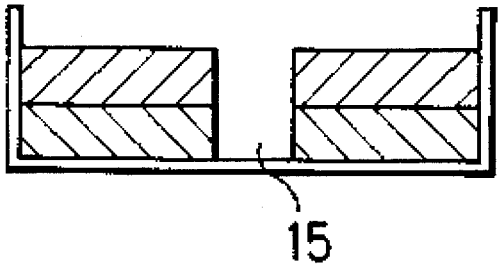
Figure 5C:
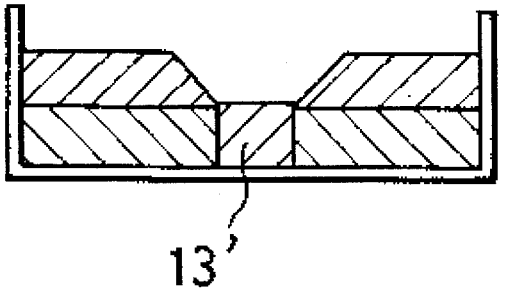
Figure 5D:
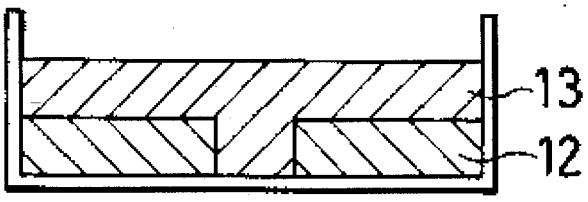
Figure 6A:
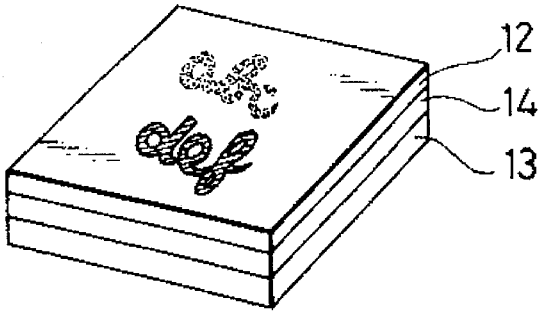
FIG. 6(*a*) is a perspective view showing a second example of a shaped article produced according to the invention.
Figure 6B:
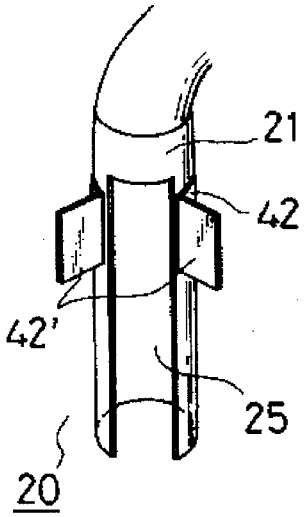
Figure 6C:
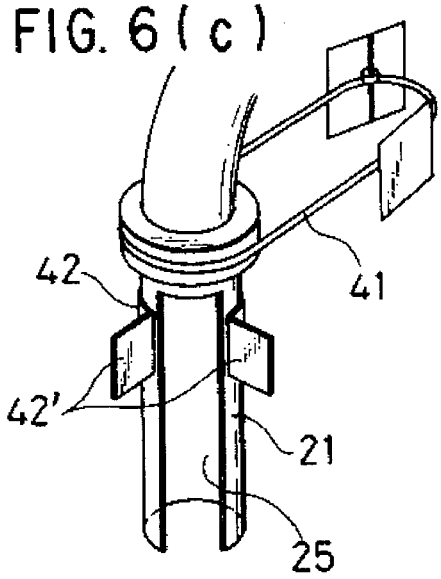

The method of producing patterned shaped articles according to the present invention, using the air flow controller proposed by the present inventors in a previous patent application, Japanese Patent Application No. 5-229643, makes it possible to express detailed, diverse patterns by forming at least two different superposed courses of dry particles on a base surface and using the air flow controller to form a cavity in at least the lower dry particle course and charging the cavity with dry particles from the upper dry particle course or a different type of dry particles. By using any of various types of air flow controller, and at least one parameter among air pressure, air flow rate, air flow speed, air flow direction, air flow pulsation, air flow intermittence, suction port size, blow port size, suction port position and blow port position, and varying the particle course forming method and the type of particles and the like, the method of this invention makes it possible to produce various patterns. FIG. 1 shows an example of a shaped article patterned with the letter B expressed in dots, FIGS. 2–5 show examples of cavity formation for producing the patterned shaped article of FIG. 1 using an air flow controller having a suction port, FIG. 6 shows an example of a shaped article patterned with letters expressed in lines, FIGS. 7–10 show cavity formation for producing the patterned shaped article of FIG. 6(*a*), using an air flow controller having a suction port, FIG. 14(*a*) shows an example of a shaped article patterned with a mountain scene produced from a photograph, and FIGS. 15–18 show an example of cavity formation for producing the patterned shaped article of FIG. 14(*a*), using an air flow controller having a blow port. For simplicity the explanation relates mainly to suction port and blow port arrangements, so that in some cases aspirators, compressor controllers, positioning devices and other such devices are not illustrated.

Although the particles for producing a particle course on a base surface may either be dry or have absorbed one or more of water, oil, lubricant-bonding agent, solvent, setting agent or plasticizer, they are not kneaded with water, oil, lubricant-bonding agent, solvent, setting agent or plasticizer and are in a dry state readily broken up for supply.

FIG. 1 shows a shaped article having a B pattern formed by dots in a 7-by-7 matrix in which the dots are all the same size and are constituted by red particles of an upper course 13 of dry particles on a white lower course 12 of different dry particles that has become the surface layer. This shaped article can be formed in accordance with the method of the invention using any air flow controller having a suction port or a blow port or both. To simplify the explanation, however, the description will be made with reference to the case where the cavities are formed using an air flow controller equipped with the suction port 21 shown in FIG. 2(*c*). A composite course 11 is formed of a lower course 12 of white particles on a base surface 10 such as the bottom plate of a form 18 overlaid by an upper course 13 of red particles (FIG. 2(*a*)). As shown in FIG. 3(*a*), the suction port 21 is inserted to near the base surface 10 at the bottom of the composite course to form cavities by sucking up particles from the upper and lower courses 13 and 12. As shown in FIG. 3(*b*), the air flow forms a tapered cavity 15 in the shape of a conical frustum starting as a circle on the base surface and expanding upward to the surface of the composite course. In this case, the size and shape of the cavity formed can be controlled by using an adjustable suction port with a variable diameter, by increasing only the suction force or by varying the position of the suction port between the upper and lower regions of the composite course. FIG. 4(*a*) shows an example in which the tip of the suction port 21 is fitted with a disk-shaped skirt 22. Multiple breather holes 23 of diameters smaller than that of the suction port 21 are formed in the portion of the skirt 22 next to the suction port 21 to control the flow of air around the suction port 21 by blocking most of the air flow but allowing a small amount of air to flow through the breather holes 23. In the illustrated example, the suction port with the skirt is positioned above the upper surface of the upper particle course. Since the air flowing through the breather holes 23 first passes downward before rising into the suction port, the frustum-shaped cavity 15 can be formed with a smaller taper angle than in the case of the cavity of FIG. 3. In the case of this arrangement it is preferable to conduct the suction in discrete pulses so as that the air will flow down through the breather holes and then up into the suction port in a sharply defined pattern, making it possible to produce the cavity 15 that extends from the upper surface of the upper particle course to the base surface. FIG. 5(*a*) shows another suction example in which the suction port 21 is provided with a disk-shaped skirt 22 and a breather tube 24 of a diameter smaller than that of the suction port 22 is disposed on the skirt in contact with the suction port. As in this arrangement the air flow is focused by the breather tube 24 it becomes even more sharply defined than in the cavity of FIG. 4, whereby the wall of the cavity 15 can be formed to be almost vertical. As in the case of FIG. 4, it is again preferable to conduct the suction in discrete pulses in order to ensure a sharply defined flow which minimizes the amount of stress imparted to the remaining particle course and thus ensures formation of a neat cavity. Since the sharply defined air flow through the breather tube and the pulsating suction prevent the pressure on the wall of the cavity from becoming excessively negative, the wall of the cavity can be formed to be almost vertical.

Any one of the arrangements of FIGS. 3–5 can be used to produce the letter B shown in FIG. 1 by repeatedly conducting the steps of producing dot cavities 15 of a prescribed shape in the lower course using the above method, and charging each cavity 15 with particles 13'from the upper course 13 by means such as applying vibration to the upper course 13 or raking particles from the upper course 13 into the cavities 15. As shown in FIG. 2(*d*), a raking member 41 rotatably affixed to the suction port 21 can be used to continuously rake in particles from slightly behind the formed cavities relative to the direction of advance. After the pattern has thus been formed it is set into an integral mass, either as it is or after being smoothed (including by using the same particles as those of the upper course to fill in cavities flush with the upper surface), and after also being overlaid with a backing course, if required.

Figure 7A:
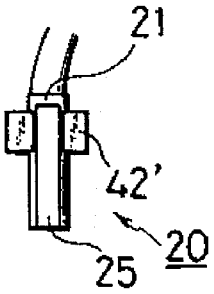
FIG. 7(*a*) is a front view of the suction port of FIG. 6(*b*).
Figure 7B:
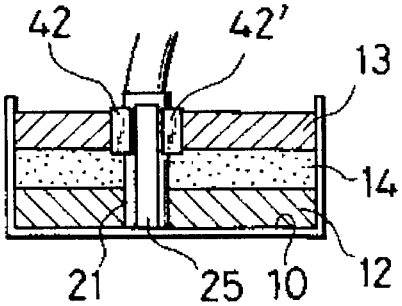
Figure 7C:
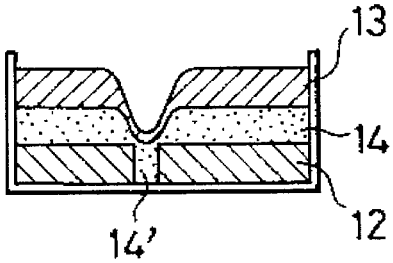
Figure 8A:
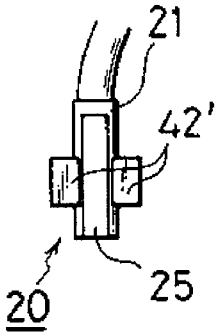
FIG. 8(*a*) is a front view of the suction port of FIG. 6(*b*).
Figure 8B:
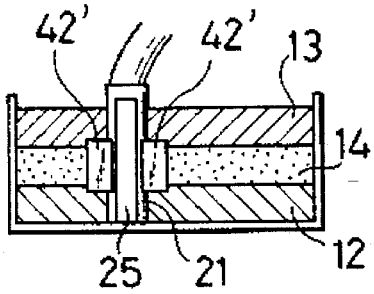
Figure 8C:
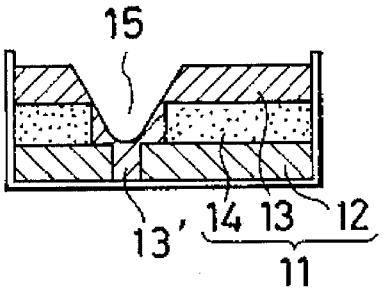

FIG. 6(*a*) shows an example of a shaped article patterned with alphabet letters expressed in continuous lines, formed using an air flow controller equipped with a suction port. In this case, in the white surface lower course 12 the letters "abc" are expressed by using a blue intermediate course 14 and "def" by using the red upper course 13. As shown by FIG. 6(*b*), to form this, an air flow controller 20 is used having a suction port 21 that on one side has an opening 25 that starts from the tip of the port and extends a distance equal to the thickness of the three courses. The suction port 21 is also provided with a C-shaped expanded diameter member 42 that is vertically movable on the suction port 21 and has a guide plate 42' at each end thereof. The composite course 11 is formed of three courses of dry particles: a white particle lower course 12 on the base surface, a blue intermediate course 14 and a red upper course 13. With the expanded diameter member 42 moved up to the height of the red upper course 13, as shown in FIG. 7(*a*), at the point at which the letter "a" is started the suction port 21 is inserted down into the composite course 11 until it contacts the base surface. The suction port is then moved in the pattern of the letters while sucking up particles until the letter "c" is finished. The combination of the particle suction by the wide sweep of the red upper course 13 by the guide plates 42' and the narrow sweep of the opening 25 produces the cavity 15 in which the lower part is filled by intermediate course blue particles 14' to thereby form a blue pattern in the white lower course 12 (FIG. 7(*c*)). With reference to FIGS. 8(*a*) and 8(*b*), by moving the expanded diameter member 42 to the height of the blue intermediate course 14 and inserting the suction port 21 down to the base surface at the point at which the letter "d" starts, and then moving the suction port in the pattern of the letters while sucking up particles until the letter "f" is finished, the combination of the particle suction by the wide sweep of the intermediate course 14 and the narrow sweep of the lower course 12 and upper course 13 by the opening 25 produces the cavity 15 in which the lower part is filled by upper course red particles 13' to thereby form a red pattern in the white lower course 12. In this way, "abc" and "def" are expressed in continuous lines. As shown in FIG. 6(*c*), a raking member 41 rotatably affixed to the suction port 21 can be used to continuously rake in particles from slightly behind the formed cavities. After the patterned particle course is thus formed, it is set into an integral mass, as in the case of FIG. 1, either as it is or after being smoothed, and after also being overlaid with a backing course, if required.

Figure 9A:
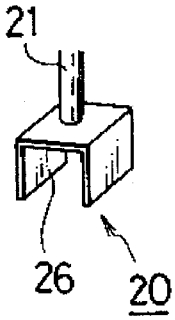
FIG. 9(*a*) is a perspective view showing a fifth example of a suction port.
Figure 9B:
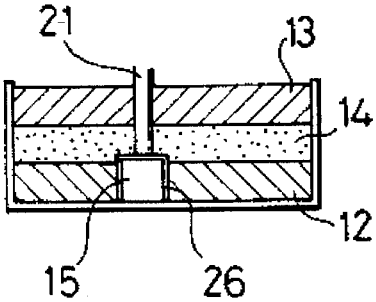
Figure 9C:
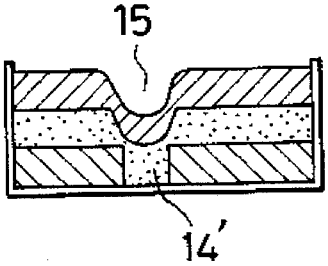

An air flow controller 20 having a suction port of a different shape may be used. In FIGS. 9(*a*) and 10(*a*), for example, a skirt 26 in the shape of a squared inverted letter U is affixed to the suction port 21. In FIG. 9(*a*) the length of the skirt 26 is slightly more than the thickness of the lower course 12, while in FIG. 10(*a*) the length of the skirt 26 is slightly more than the combined thicknesses of the lower course 12 and intermediate course 14. Particle suction is performed while moving each skirt inserted into the composite course 11 down to the base surface 10. In the case of the skirt shown in FIG. 9(*a*) the intermediate course and upper course are above the skirt and so only the particles of the lower course are sucked away to thus form a cavity 15 into which particles of intermediate course 14 and upper course 13 fall, whereby the pattern is expressed by the red particles 14' of the intermediate course 14 in the white lower course 12. In the case of the skirt shown in FIG. 10(*a*) the lower course 12 is above the skirt so that only the particles of the intermediate course 14 and lower course upper course 13 are sucked away to thus form the cavity 15, whereby the pattern is expressed in the white lower course 12 by the blue particles 13' of the upper course 13 falling into the cavity 15.

Figure 11:
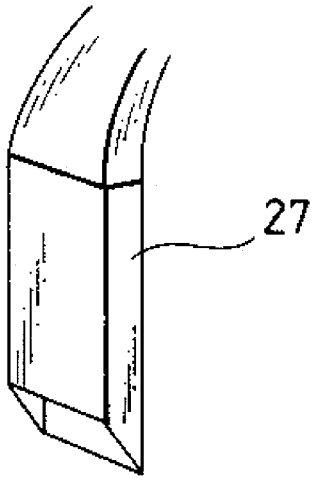
FIG. 11 is a perspective view showing a seventh example of a suction port.
Figure 12A:
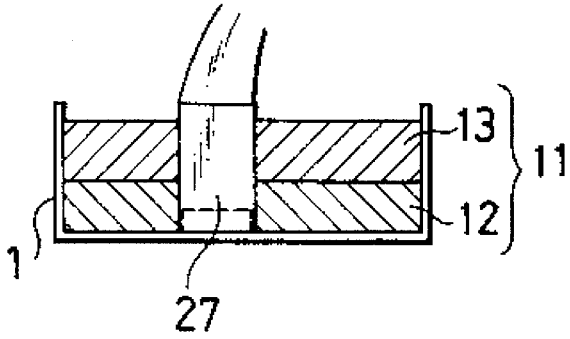
FIGS. 12(*a*) and 12(*b*) illustrate the formation of a thick-line pattern using the suction port of FIG. 11.
Figure 12B:
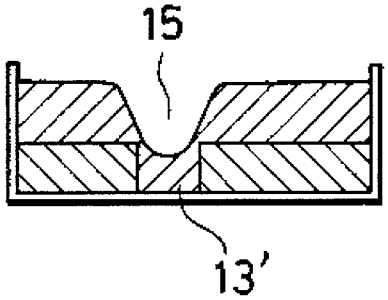

In the arrangement shown in FIG. 11, a suction nozzle 27 having a rectangular cross-section and a sloping nozzle opening is inserted in the composite course 11 until the nozzle contacts the base surface 10, as shown in FIG. 12(*a*), and the nozzle is then moved while particles are sucked away from the lower course 12. By controlling the relative speed of the suction nozzle and the suction force so that particles of the upper course are not removed by suction, a cavity can be formed in the lower course 12 to the rear of the nozzle, relative to the direction of nozzle advance, into which upper course particles 13' flow, whereby a pattern can be expressed in the lower course 12 by particles of the upper course 13 (FIG. 12(*b*)).

Figure 13A:
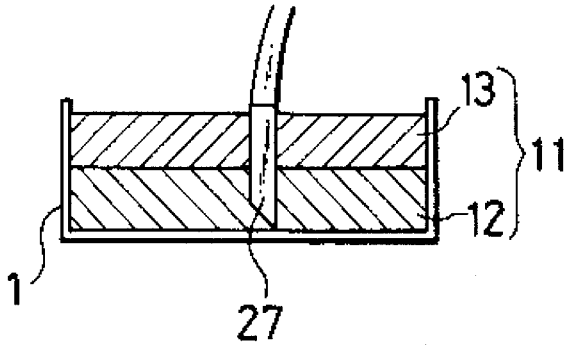
FIGS. 13(*a*) and 13(*b*) illustrate the formation of a thin-line pattern using the suction port of FIG. 11.
Figure 13B:
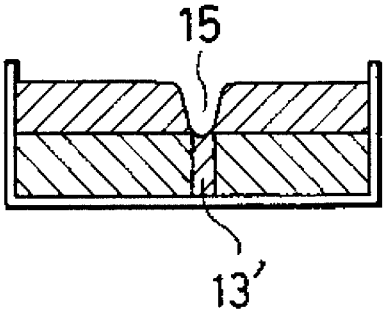

By moving the suction nozzle 27 while maintaining the long side of the nozzle at 90 degrees to the direction of advance (FIG. 12(*a*)), particles of the lower course 12 are removed vertically substantially across the width of the nozzle, forming a cavity at the rear, with respect to the direction of advance, into which upper course particles 13' fall, thereby producing a wide pattern. A slender curve can be expressed by removing particles from the lower course 12 while maintaining the long side of the nozzle at zero degrees relative to the direction of advance (FIG. 13(*a*)), thereby forming, to the rear of the nozzle, with respect to the direction of advance, a cavity having a width that is less than the width of the nozzle 27 can be formed which fills with upper course particles 13'. While "abc" can thus be expressed in red and "def" in blue by forming a red upper course 13 and blue intermediate course 14 over the entire area of a white lower course 12, this can also be accomplished using the arrangement shown in FIG. 2(*b*) in which a red or blue course is formed on a white lower course only at those portions where the letters are to be expressed. Whether courses are formed over the entire area or just over part of the area is decided according to what is required.

Thus, while the thickness of the line that is expressed can be varied by using a rectangular suction nozzle 27 and changing the angle that the long side of the nozzle forms with respect to the direction of advance, line width is not limited to being thus expressed, but may also be expressed in various other ways such as by changing the shape or material of the suction nozzle, and the position and angle of the nozzle relative to the base surface.

Figure 14A:
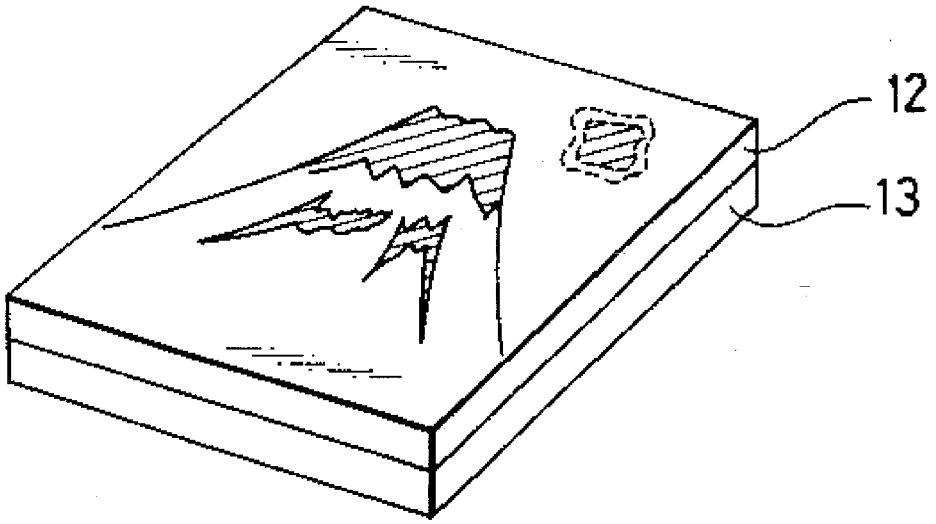
FIG. 14(*a*) is a perspective view showing a third example of a shaped article produced according to the invention.
Figure 14B:
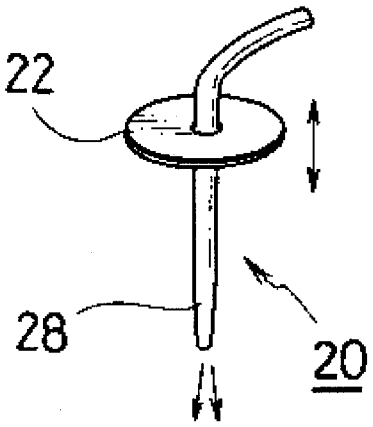
Figure 14C:
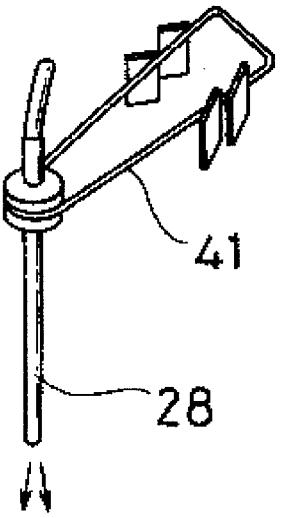
Figure 15A:
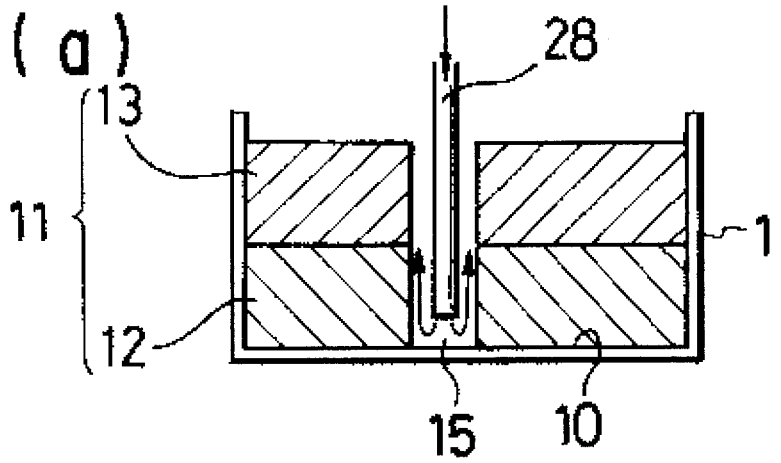
FIGS. 15(*a*) to 15(*d*) are sectional views showing a sequence used to form a fine pattern using the blow port of FIG. 14(*b*).
Figure 15B:
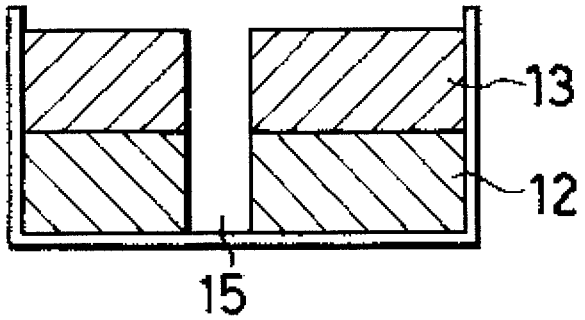
Figure 15C:
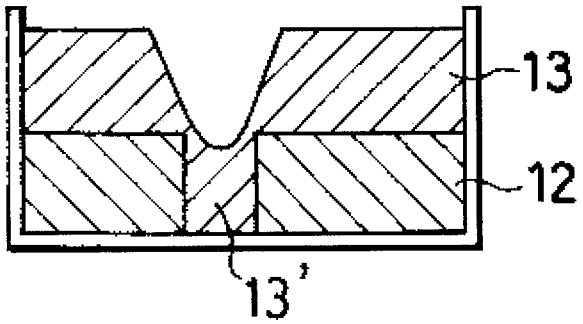
Figure 15D:
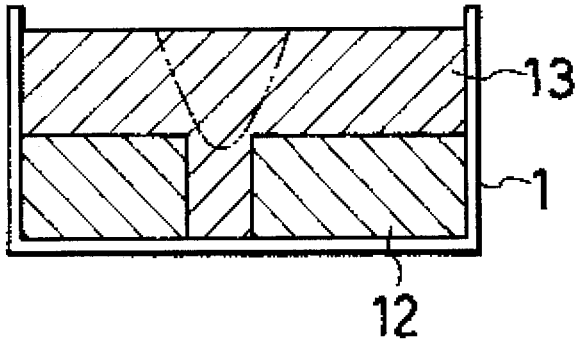
Figure 16A:
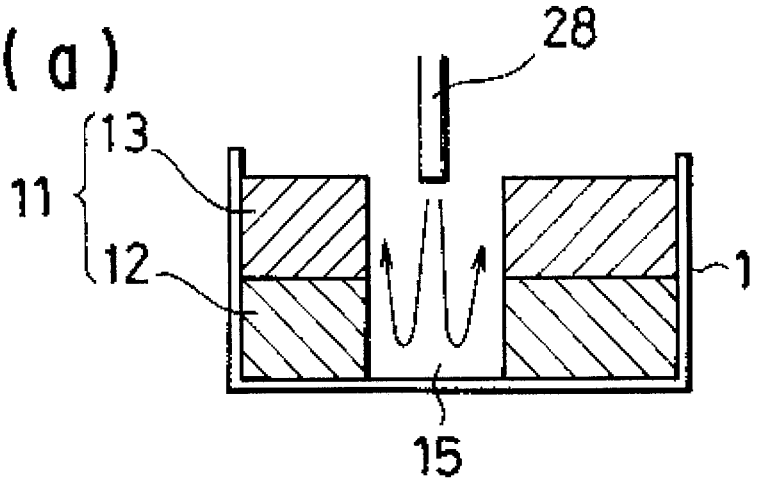
FIGS. 16(*a*) to 16(*d*) are sectional views showing a sequence used to form a broad pattern using the blow port of FIG. 14(*b*).
Figure 16B:
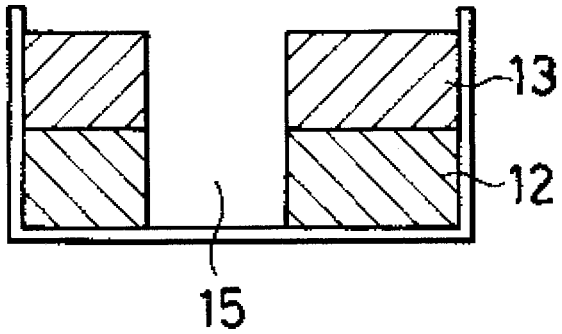
Figure 16C:
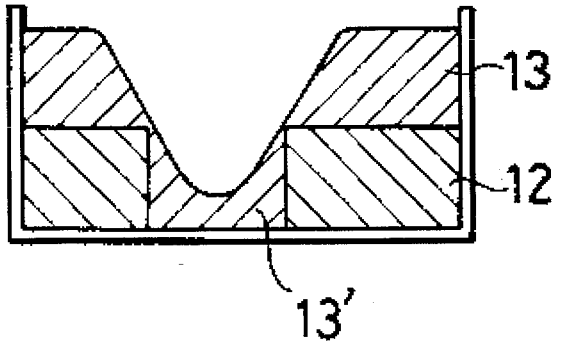
Figure 16D:
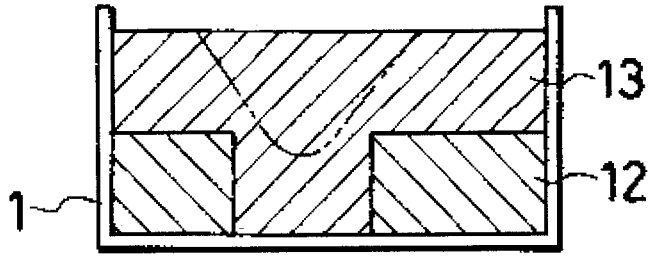
Figure 17A:
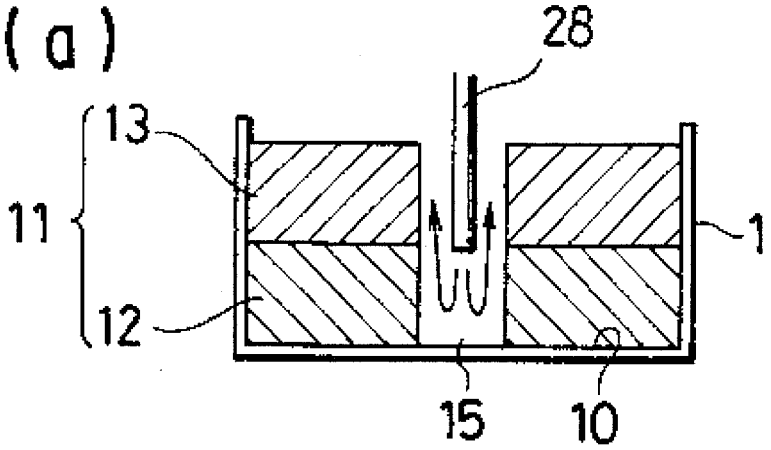
FIGS. 17(*a*) to 17(*d*) are sectional views showing a sequence used to form a pattern of medium thickness using the blow port of FIG. 14(*b*).
Figure 17B:
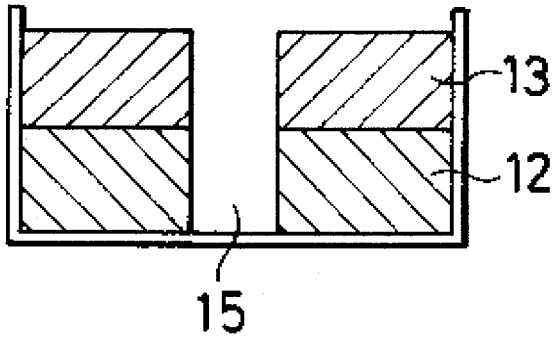
Figure 17C:
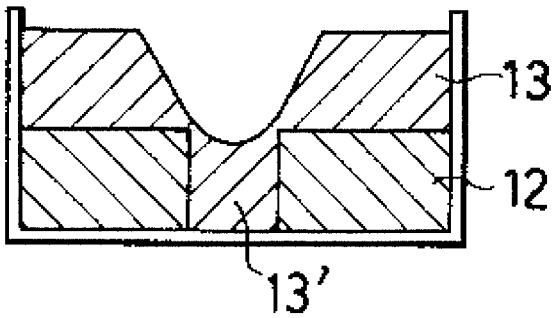
Figure 17D:
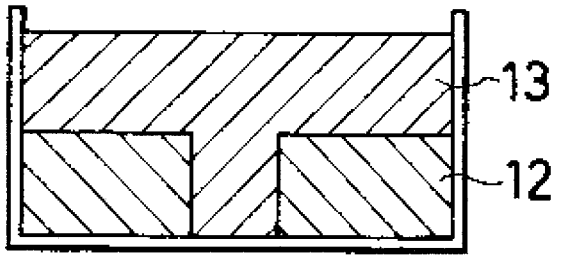
Figure 18A:
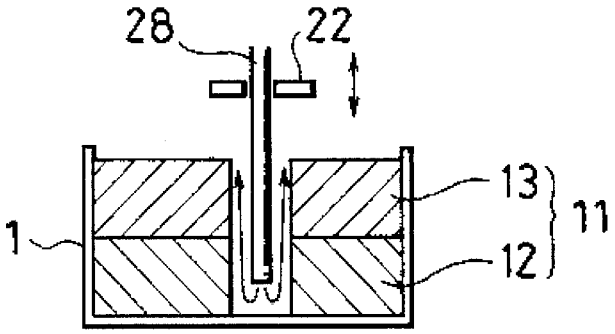
FIGS. 18(*a*) to 18(*e*) are sectional views showing a sequence used to produce a pattern formed by upper course particles and a different type of particles, using the blow port of FIG. 14(*b*).
Figure 18B:
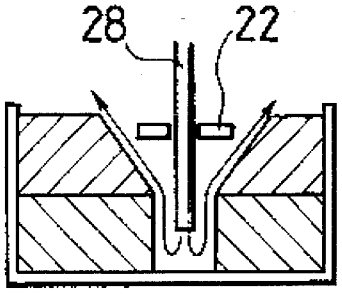
Figure 18C:
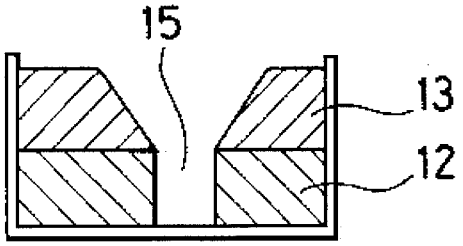
Figure 18D:
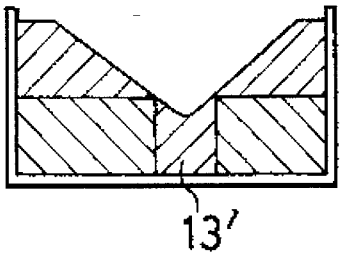
Figure 18E:
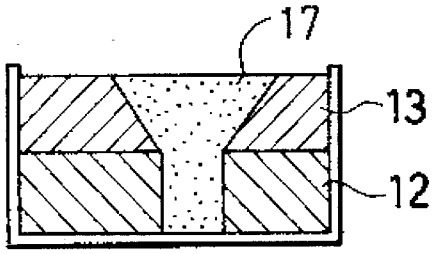

FIG. 14(*a*) shows an example of a shaped article patterned with a mountain scene produced from a photograph using dots of various sizes. This shaped article can be formed in accordance with the method of the invention using any air flow controller having either a suction port or a blow port or both a suction port and a blow port. In the interest of brevity, however, the explanation will be limited to the case where the cavities are formed using an air flow controller 20 equipped with a slender blow port 28 shown in FIG. 14(*b*) that is longer than the thickness of the composite course. The composite course consists of an upper course 13 of black dry particles laid on a lower course 12 of white dry particles on a base surface 10. With reference to FIG. 15, the blow port 28 is inserted to near the base surface 10 at the bottom of the composite course and air is blown from the port to remove particles of the two courses to thereby form a cavity. The air blown from the blow port 28 rises up along the pipe of the blow port 28 and forms a cylindrical cavity 15 in the composite particle course whose diameter is only slightly larger than that of the blow port pipe. As the air flow is constricted by the particle wall of the composite course, it follows a clean upward course and produces a slender, sharply-defined cylindrical cavity. Since the air exerts an appropriate positive pressure on the wall of the cavity, the slender cylindrical cavity 15 has a cleanly vertical wall that does not collapse, although this may also depend on the nature of the particles. The diameter of the cylindrical cavity that is formed can be varied by varying the size of the blow port 28 or by maintaining the size of the blow port constant and varying the flow speed of the blown air, etc. FIG. 16 shows an example in which the blowing of particles is conducted with the blow port 28 positioned above the upper surface of the upper particle course 12. As can be seen, for the same air flow speed and blow port, the air flow produced in this case forms a cylindrical cavity 15 of a much larger diameter than that formed by the method of FIG. 15. That is, the air flow freed from the constriction of the slender pipe and having spread until reaching a balance progressively digs down by blowing the particles away. At the beginning of this process, since the flow is not constricted by a particle course wall, the diameter of the cavity 15 formed is much greater than that in the case of FIG. 15. The size and shape of the cavity can be controlled by using a blow port that can be varied in size or by controlling the flow rate etc. of the blown air. FIG. 17 shows an example in which air is blown at the same flow speed from the same blow port inserted to the center region of the composite course 11. This method falls midway between those illustrated in FIGS. 15 and 16 and produces a cylindrical cavity 15 of a size about midway between those of the same figures. While the air flow is constricted by the wall of the particle courses, it also has some degree of freedom, which accounts for the production of a cavity 15 of intermediate size. From this it will be understood that it is possible to control the size, shape etc. of the cavity produced merely by varying the position of the blow port between the upper and lower layers of the composite course, without varying either the size of the blow port or the flow rate of the blown air, etc. FIG. 18 shows an air flow controller 20 in which the blow port 28 is fitted with a disk-shaped skirt 22 which can be moved vertically along the blow port 28 and serves to deflect the air flow. In the illustrated method, the skirt 22 is raised to separate it from the upper surface of the upper course and a slender cylindrical cavity 15 is first formed using the method of FIG. 15 (FIG. 18(*a*)). Next, the skirt 22 is brought down near to the upper surface of the upper course 13 and air is blown from the blow port so as to form an upwardly flared tapered region above the slender cylindrical cavity (FIGS. 18(*b*) and (*c*)). Controlling the air flow at the top of the vertical wall to expand the cavity in this manner enables upper course particles to be removed from around the cavity and other particles 17 used to charge the cavity, in cases where the upper course hinders the expression of a pattern (FIG. 18(*d*)).

Any one of the arrangements of FIGS. 15–18 can be used to produce the mountain scene by repeatedly conducting the steps of forming dot cavities 15 of a prescribed shape, using the method described in the foregoing, and charging the cavities formed with the particles 13' of the upper course or with a different type of particles 17. After the pattern is completed, it is set into an integral mass, either as it is or after being smoothed or if required after being overlaid with a backing course. As shown in FIG. 14(*c*), an air flow controller 20 having a raking member 41 rotatably affixed to the blow port 28 can be used to continuously rake in upper course particles from slightly behind of the formed cavities.

Figure 19A:
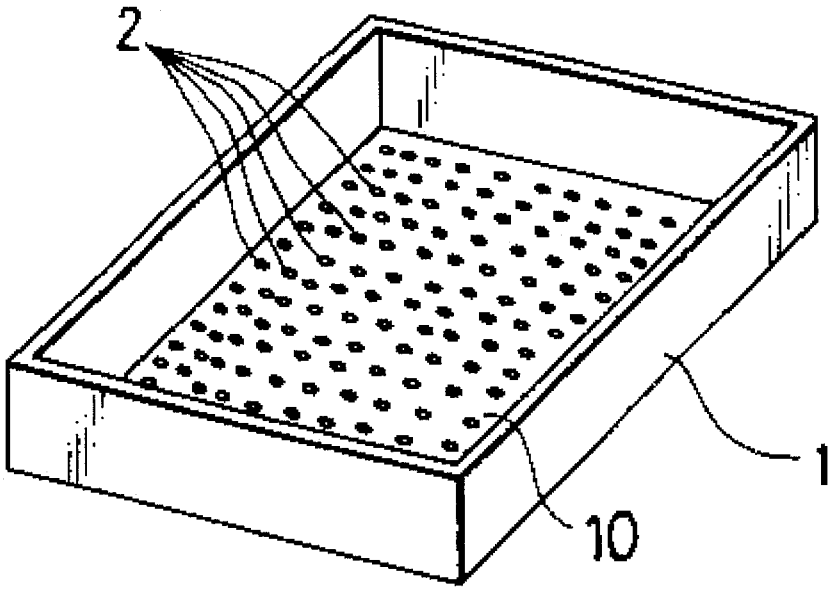
FIG. 19(*a*) is a perspective view showing a first example of a form with a perforated base surface (bottom plate).
Figure 19B:
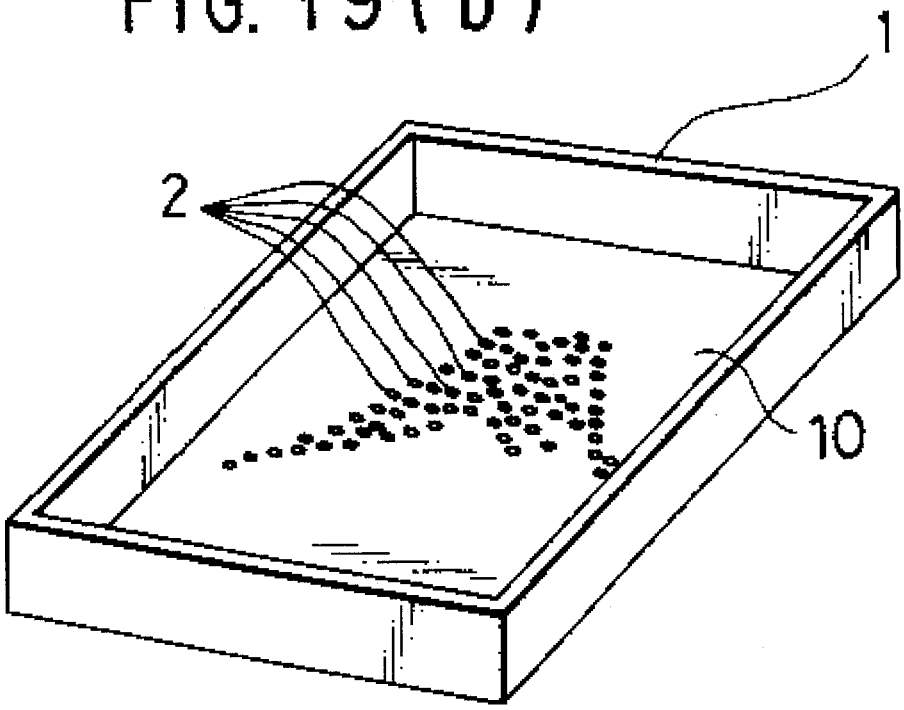
Figure 20A:
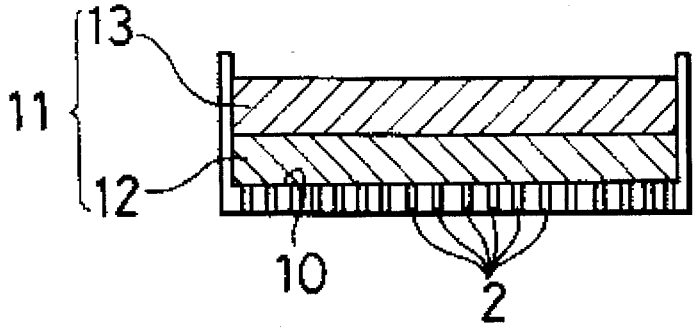
FIGS. 20(*a*) to 20(*c*) show a sequence used to form a pattern by blowing from below and using the form of FIG. 19(*a*).
Figure 20B:
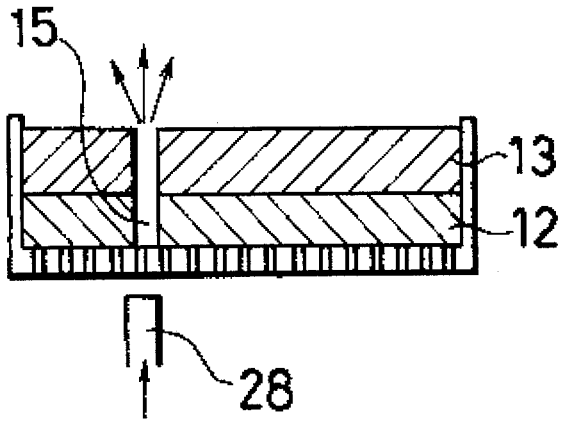
Figure 20C:
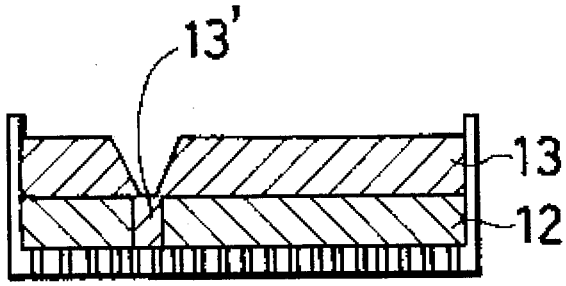
Figure 21:
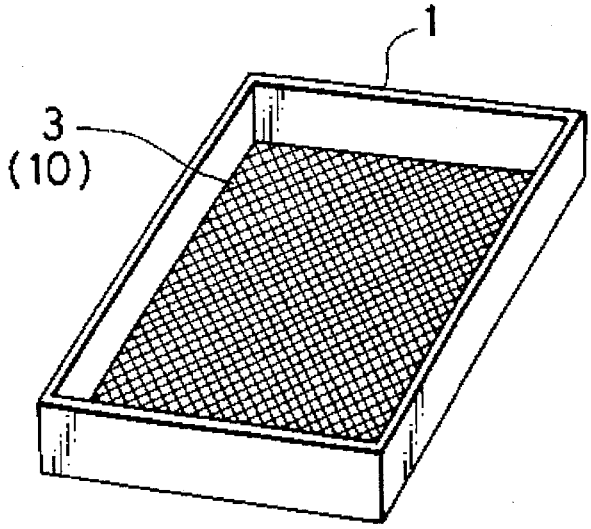
FIG. 21 is a perspective view showing a third example of a form with a perforated base surface (bottom plate).

Patterns can be formed using an arrangement in which, as shown in FIG. 19(*a*), the entire surface of a bottom plate of a form 1 constituting the base surface 10 is perforated with holes 2 smaller than the particles, or as shown in FIG. 19(*b*), just the pattern portions can be perforated. A lower course 12 of white particles is placed on this base surface 10 and overlaid with an upper course 13 of black particles, and as shown in FIG. 20 the blow port 28 is then used to remove particles of the upper and lower courses by blowing air up from below the bottom plate, forming a cavity 15 into which upper course particles 13' are vibrated or raked to form the pattern. As shown in FIG. 21, an air-permeable sheet or mat 3 of unwoven fabric or network material can be used as the base surface 10 through which air is blown up from a blow port 28 positioned below the sheet or mat 3 to remove particles of the upper and lower courses 13 and 12. In the case of this arrangement, for example, a lower course 12 of white particles is placed on a base surface of nonwoven fabric and overlaid with an upper course 13 of black particles, and the blow port 28 is then used to remove particles of the upper and lower courses by blowing air up from below the nonwoven fabric, thereby forming in the composite course cavities 15 into which upper course particles 13' are vibrated or raked to produce a pattern. In the case of both FIGS. 20 and 22, after the pattern has been formed it is set into an integral mass either as it is or after also being overlaid with a backing course, or the particles are set after a sheet or the like is used to form a new base surface on which the composite particle course is turned upside down.

Figure 22A:
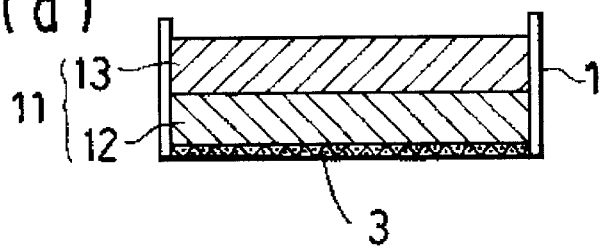
FIGS. 22(*a*) to 22(*c*) show a sequence used to form a pattern by blowing from below and using the form of FIG. 21.
Figure 22B:
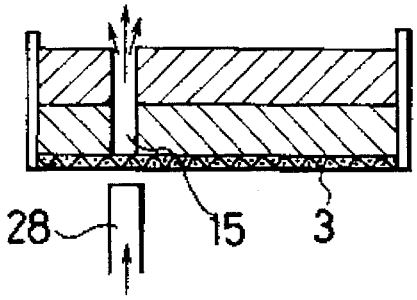
Figure 22C:
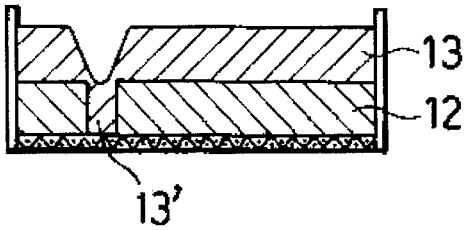
Figure 23:
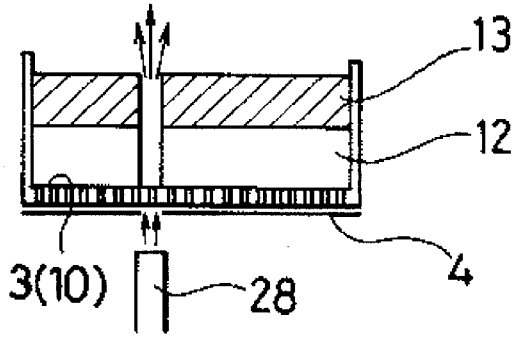
FIG. 23 is a sectional view showing pattern cavity formation by blowing from below and using the form of FIG. 19 or FIG. 21 and a mask.

In the case of both FIG. 20 and FIG. 22, the arrangement of FIG. 23 can be used in which a permeable mask is used to close off the base surface perforations or part of the permeable sheet or mat 3 or the like located in the pattern area and particles of both courses are removed by air blown upwards from a blow port 28 positioned below, to thereby form a cavity 15. For this, using a slit-shaped blow port nozzle that is longer than one side of the base surface 10 and moving the nozzle in the direction of the other side of the base surface enables the particles to be removed with good efficiency.

Figure 24A:
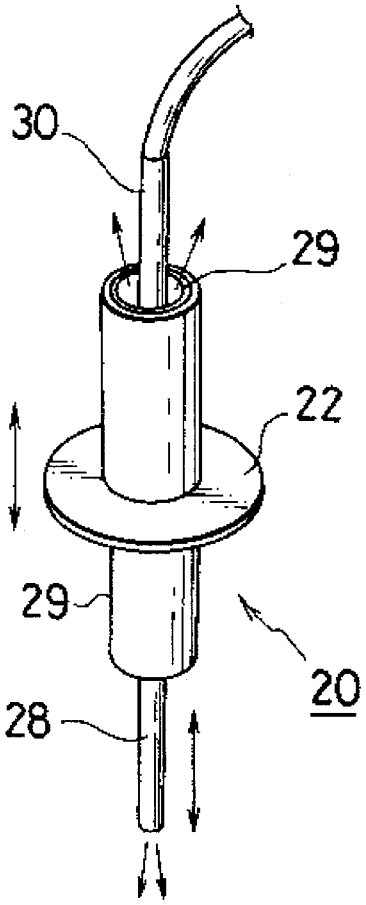
FIG. 24(*a*) is a perspective view showing a third example of a blow port.
Figure 24B:
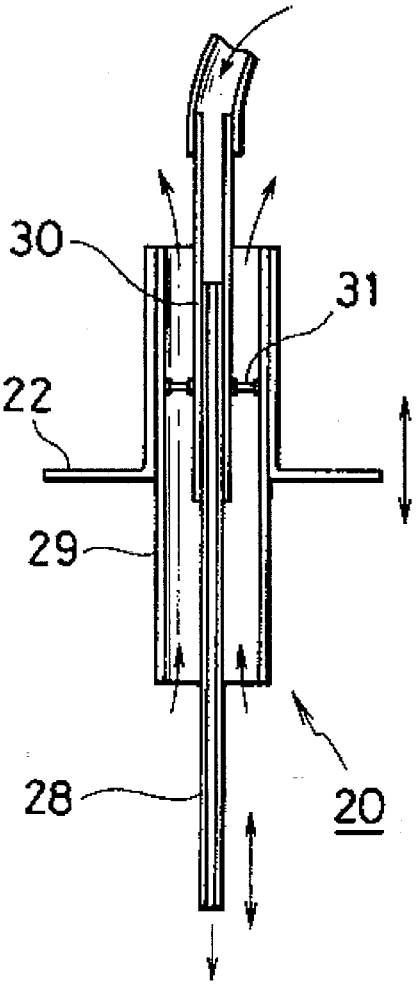

FIGS. 24(*a*) and (*b*) show another example of an air flow controller 20 used to express the letters "abc" in a continuous blue line and the letters "def" in a continuous red line in a white background, as shown in FIG. 6. The air flow controller 20 comprises an exhaust pipe 29, a support tube 30 that protrudes centrally down from above into the upper half of the exhaust pipe to which it is affixed by radial arms 31, and which supports a downwardly extendible blow port 28, and a disk-shaped skirt 22 that can be moved vertically along the outside of the exhaust pipe 29. The position of the lower end of the blow port 28 projecting down from the exhaust pipe 29 and the vertical position of the skirt 22 can be adjusted as desired.

Figure 25A:
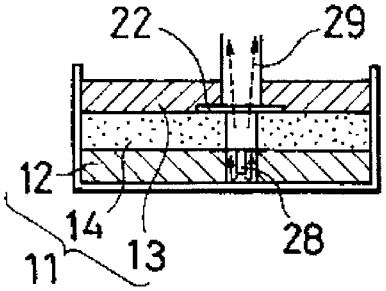
FIGS. 25(*a*) to 25(*c*) show a sequence used to form a blue line pattern, using the blow port of FIG. 24.
Figure 25B:
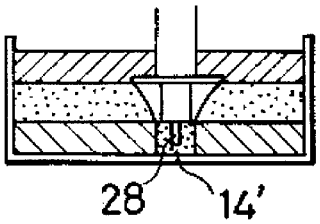
Figure 25C:
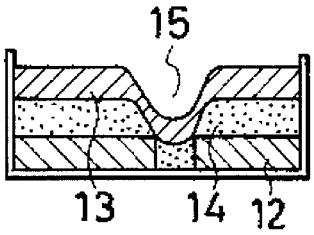
Figure 26A:
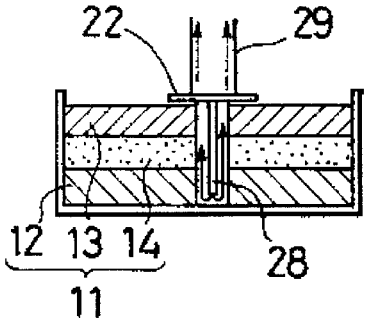
FIGS. 26(*a*) to 26(*c*) show a sequence used to form a red line pattern, using the blow port of FIG. 24.
Figure 26B:
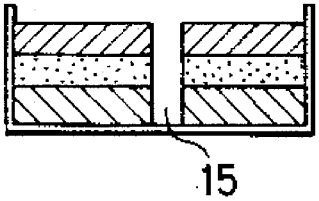
Figure 26C:
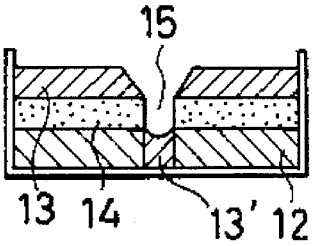

In this arrangement consisting of a lower course 12 of white dry particles on a base surface 10 overlaid by a blue intermediate course 14 and a red upper course 13, in order to express the continuous-line letters "abc" in blue, the skirt 22 is positioned between the upper surface of the intermediate course 14 and the lower surface of the upper course 13 and the blow port 28 is inserted to the position on the base surface at which the letter "a" is started. The end of the exhaust pipe 29 is positioned between the upper surface of the lower course and the lower surface of the intermediate course. By then blowing air from the blow port 28 while moving the air flow controller 20 from the letter "a" position to the position at which the letter "c" is completed, white particles from the lower course are expelled from the exhaust pipe 29 together with the air, producing cavity 15. Blue particles 14' from the intermediate course 14 then fall into the cavity 15, producing "abc" written in blue in the lower surface of the white lower course 12 (FIG. 25(*b*)). After the passage of the skirt 22, the particles 13' of the upper course that had been supported by the skirt fall into the depression formed in the intermediate course (FIG. 25(*c*)).

To produce the letters "def", the length of the blow port 28 projecting from the exhaust pipe 29 is increased and the blow port 28 inserted to the point on the base surface at which the letter "d" starts. The skirt 22 and the end of the exhaust pipe 29 are positioned on the red upper course 13. By then blowing air from the blow port 28 while moving the air flow controller 20 from the letter "d" position to the position at which the letter "f" is completed, particles from the three layers of the composite course are expelled from the exhaust pipe 29 together with the air, forming cavity 15. The red particles of the upper course are then vibrated or raked into the cavity to produce the letters "def" expressed in red on the lower surface of the white lower course 12. After the patterned particle course has thus been formed, it is set into an integral mass, as in the case of FIG. 1, either as it is or after being smoothed, and also after being overlaid with a backing course, if required. A slender cavity pattern can be formed by removing particles using the blow port 28 inserted to the base surface, both when the skirt 22 is positioned on the red upper course 13 and when it is positioned between the upper course 13 and the intermediate course 14. A larger-diameter cavity pattern can be produced by moving the blow port up from the base surface.

Figure 27A:
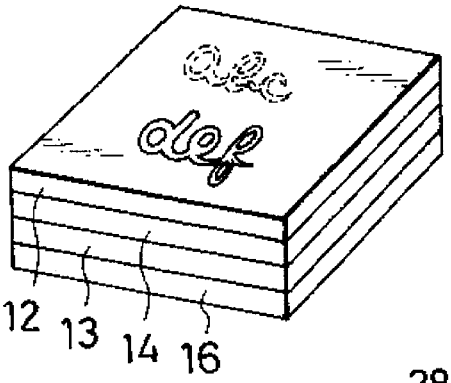
FIG. 27(*a*) is a perspective view showing a fourth example of a shaped article produced according to the invention.
Figure 27B:
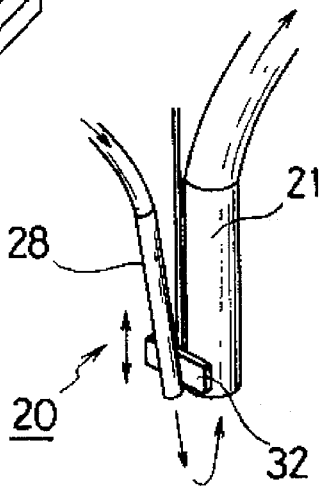
Figure 27C:
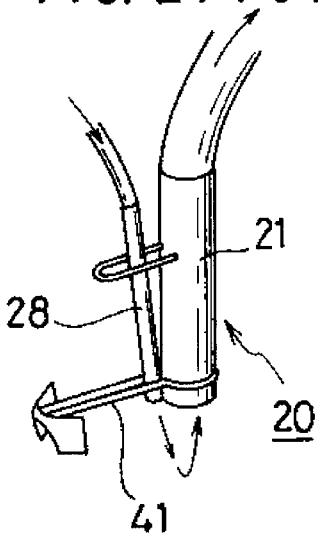
Figure 28A:
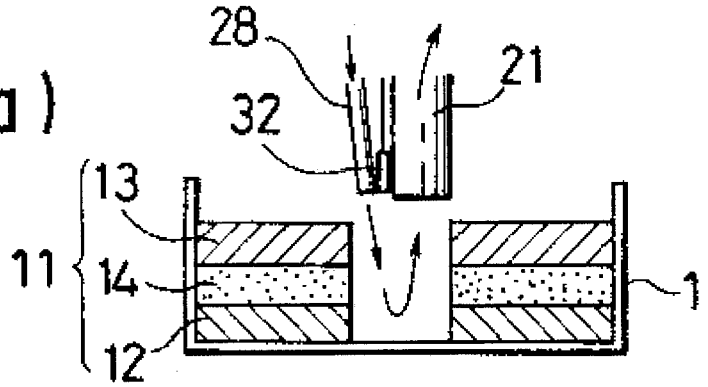
FIGS. 28(*a*) to 28(*d*) illustrate pattern formation using the air flow controller of FIG. 27(*b*).
Figure 28B:
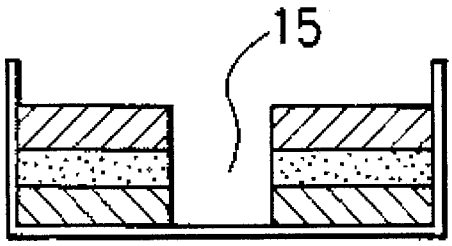
Figure 28C:
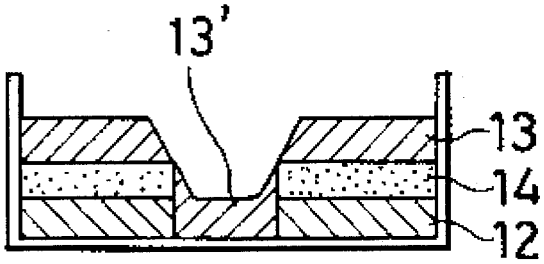
Figure 28D:
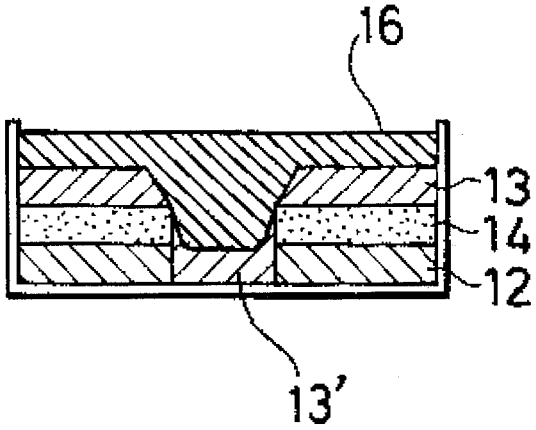

FIG. 27 shows a shaped article having a four-course structure. There are a white surface course patterned with the letters "abc" in blue and "def" in red, red and blue undercourses 13 and 14 and a backing course 16. This shaped article can be formed in accordance with the method of the invention by using an air flow controller 20 having either a suction port 21 or a blow port 28 shown in FIG. 2(*c*) and FIG. 14(*b*). However, here the explanation will be made with reference to cavities formed using an air flow controller 20 equipped with both a suction port and a blow port. FIG.

Figure 29A:
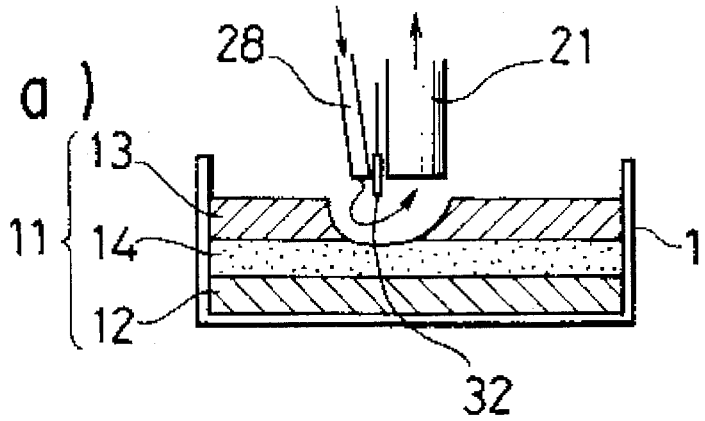
FIGS. 29(*a*) and 29(*b*) are sectional views showing shallow cavity formation in the upper layer of the composite course, using the air flow controller of FIG. 27(*b*).
Figure 29B:
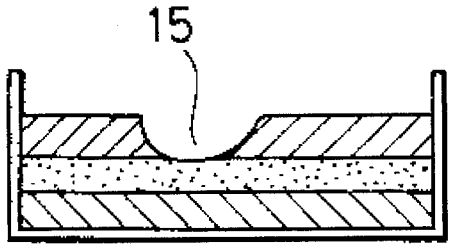
Figure 30A:
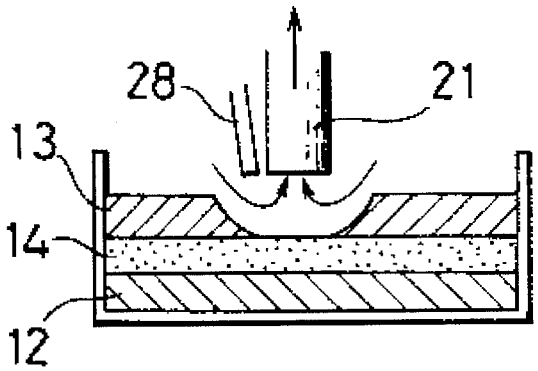
FIGS. 30(*a*) and 30(*b*) are sectional views showing shallow cavity formation in the upper layer of the composite course, using the air flow controller of FIG. 27(*c*).
Figure 30B:
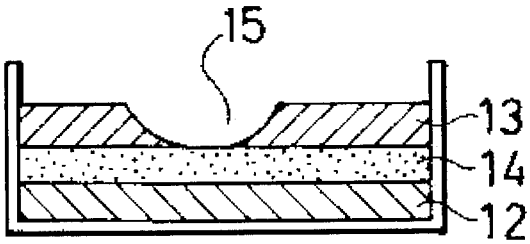
Figure 31A:
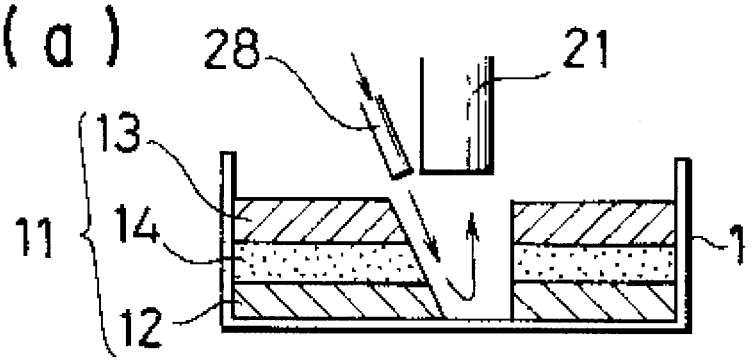
FIGS. 31(*a*) to 31(*d*) show a sequence of pattern formation using the air flow controller of FIG. 27(*c*).
Figure 31B:
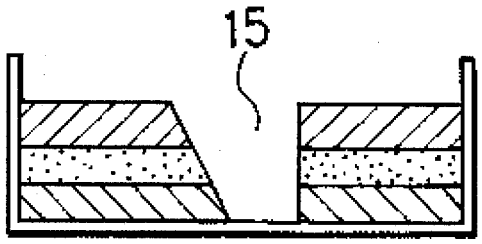
Figure 31C:
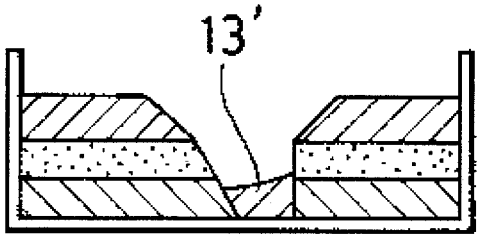
Figure 31D:
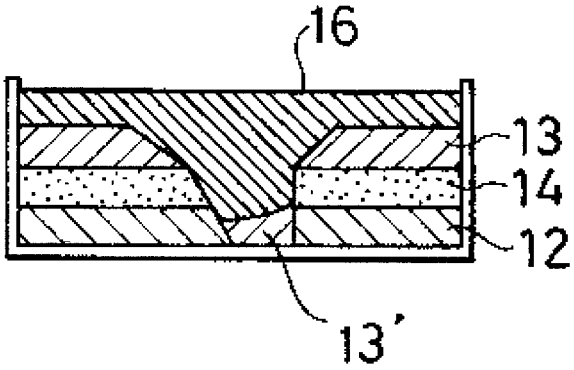
Figure 32A:
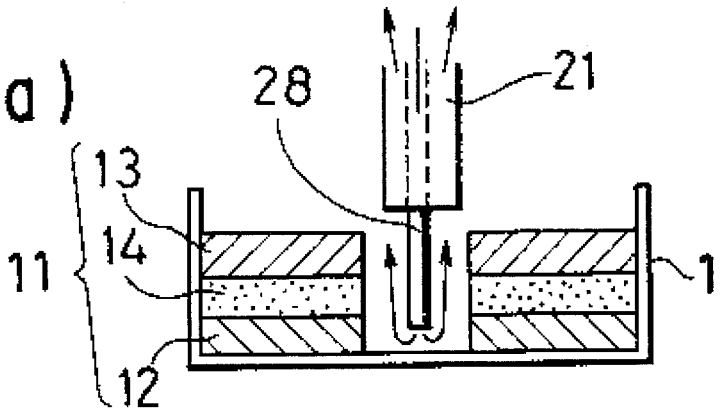
FIGS. 32(*a*) to 32(*d*) show a sequence of pattern formation using a third example of an air flow controller in which the suction port and blow port are a single assembly.
Figure 32B:
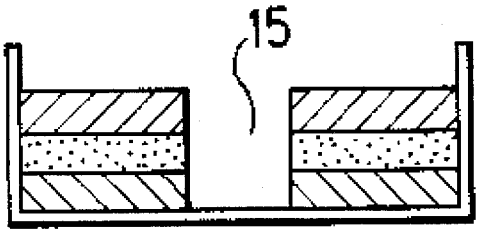
Figure 32C:
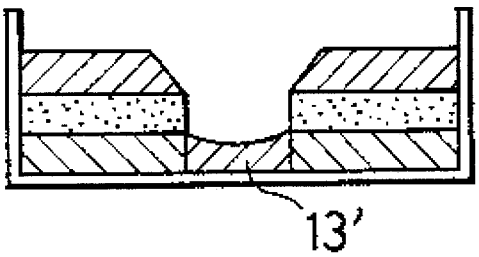
Figure 32D:
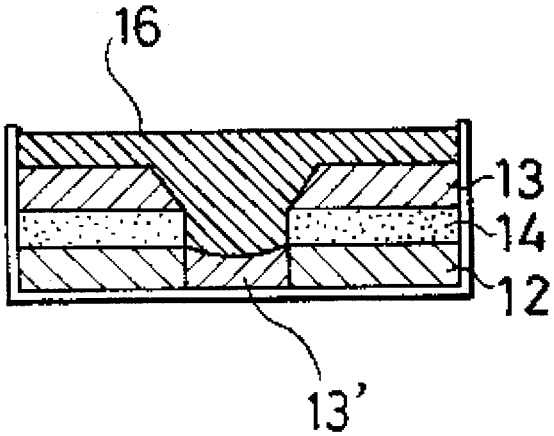
Figure 33A:
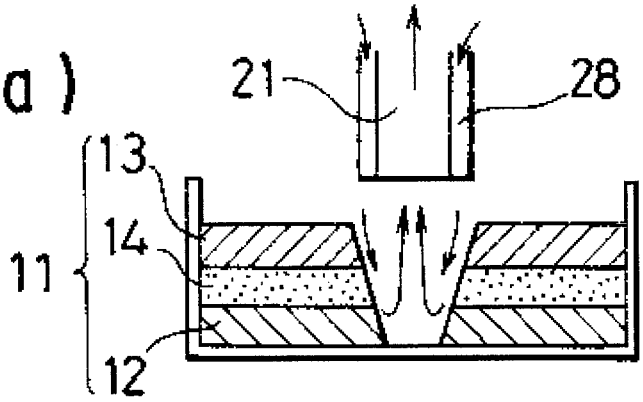
FIGS. 33(*a*) to 33(*d*) show a sequence of pattern formation using a fourth example of an air flow controller in which the suction port and blow port are a single assembly.
Figure 33B:
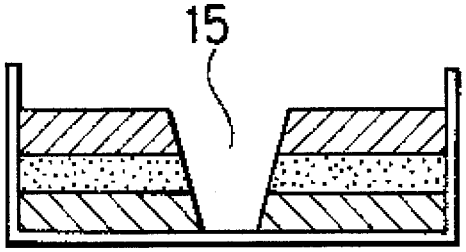
Figure 33C:
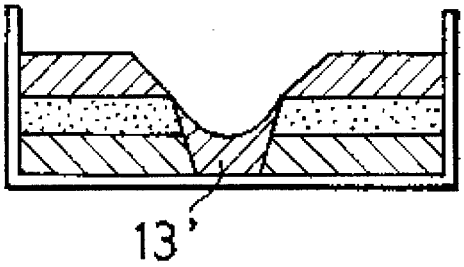
Figure 33D:
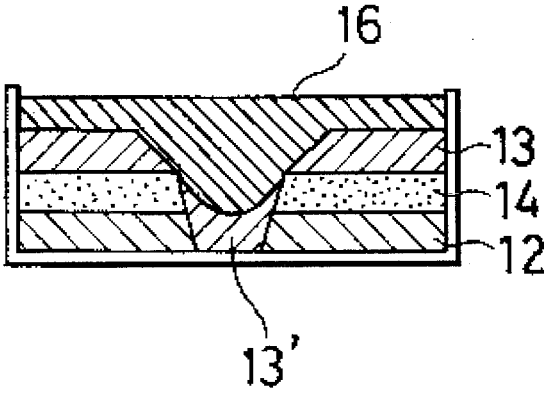

28(*a*) shows a triple-course arrangement formed by laying a white particle lower course 12 on a base surface 10 followed by a blue particle intermediate course 14 and a red particle upper course 13. An air flow controller having a suction port 21 and an adjacent blow port 28 of smaller diameter than the suction port is positioned at the upper surface of the upper course 13 and moved while air is blown by blow port 28 and air is sucked by the suction port 21. Air is blown from the blow port 28 into the interior of the particle courses and, making a U-turn, is sucked into the suction port 21. Most of the air flowing into the suction port 21 is air blown from the blow port 28, with little air flowing into the suction port 21 from around the suction port. Thus, it is possible to produce a sharply defined U-shaped flow by controlling the suction force and the amount, speed, and direction, etc., of the blown air. As the removed particles are being entrained by this flow, the suction port 21 and the blow port 28 are moved over the surface of the particle course in the pattern of the letters to be formed, producing a vertically-walled cavity 15 as shown in FIG. 28(*b*). A balance should preferably be established for making the air pressure against the walls of the groove appropriately positive, and for ensuring formation of a continuous cavity with vertical walls the pressure should be kept from becoming any more negative than necessary, although this also depends on the nature of the particles. The width, shape and the like of the cavity thus formed can be varied by varying the size of the blow port and/or the suction port, or by varying the flow speed of the blown air while maintaining the sizes of the blow port and the suction port constant, or the air flow can be made sharper or more moderate by varying the suction force or the like. Moreover, positioning the skirt 22 as shown in FIG. 18 to expand the air flow in the vicinity of the suction port enables particles 13' to be removed if necessary from the upper course at the top of the cavity (FIG. 28(*c*)), and other particles 16 used to charge the cavity (FIG. 28(*d*)). In the case of FIG. 29, for example, the air flow can be expanded to remove just upper course particles by lowering a deflector plate 32 in front of the blow port 28 that changes the direction of the air flow. FIG. 30 shows an example in which the blow port 28 is closed so that upper course particles are removed by suction alone. However, it is to be understood that these examples are not limitative, and there are other arrangements that can be used. For example, the air flow at the top of the vertical wall of the cavity 15 can be controlled to remove an upper course portion and the red of the upper course 13 can be made the upper surface by removing particles of the intermediate course 14, and in that state form a cavity that reaches from the upper course to the base surface and is charged by upper course red particles to thereby express a red pattern. Thus changing the upper course through the removal of particles enables a pattern to be expressed using a different type of materials, and courses to be formed using a different type of particles.

Figure 34:
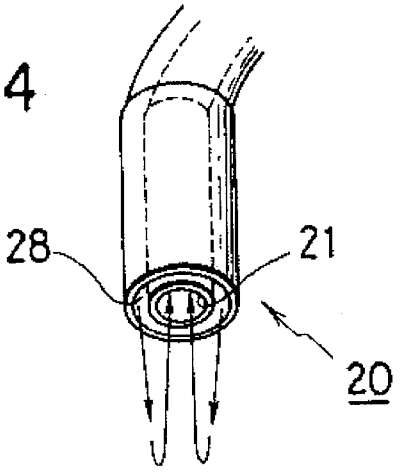
FIG. 34 is a perspective view of the air flow controller of FIG. 33(*a*).

An air flow controller having a suction port 21 and an adjacent blow port 28 of smaller diameter than the suction port is positioned at the upper surface of the upper course 13 and moved while air is blown by blow port 28 and air is sucked by the suction port 21. FIG. 31 shows an example in which an air flow controller with the blow port 28 slightly separated from the suction port 21 and adapted to blow air at an angle is positioned with its suction port 21 and blow port 28 at the same height as in the case of FIG. 28, namely with the suction port 21 and blow port 28 positioned at the upper surface of the upper course 13. When blowing and suction are conducted with this arrangement, the air flow passes along a wedge-like path that slopes down from the blow port 28 and then up into the suction port 21. The cavity 15 thus formed has a trapezoidal configuration with a sloped wall on the side of the blow port 28 and a vertical wall on the side of the suction port 21 opposite from the blow port 28. Where a line pattern is to be formed using the air flow controller of FIG. 28, it is advantageous to position the suction port 21 in front and the blow port 28 in back. This is because in the course of forming the cavity the particles removed from the wall in the direction of advance by the air blown from the blow port at the rear are sucked up by the suction port at the front, whereby the formed cavity is under positive pressure and not unnecessarily subjected to negative pressure. As a result, a neat cavity can be formed with high efficiency. FIG. 32 shows an example in which the arrangement is equipped with a slender blow port 28 that projects downward from the center of a suction port 21 by a considerable length and air is blown from the blow port 28 after the blow port 28 has been inserted into the lower particle course 12. With this arrangement it is possible to reduce the air to a fine flow. The cavity 15 produced in this case is thus narrower than when the method of FIG. 28 or 29 is used. Because of the central location of the blow port 28, the arrangement is conveniently able to advance in any direction. By further incorporating the vertically movable disk-shaped skirt 22 such as in the arrangement shown in FIG. 14(*b*), it also becomes possible to vary the shape of the cavity by using the skirt to deflect the air flow. FIG. 33 shows an example employing a double pipe structure, shown in FIG. 34, in which the suction port 21 is arranged within an annular blow port 28. The air blown from the blow port 28 forms a doughnut-shaped curtain which converges toward the center as it progresses toward the bottom portion of the composite particle course, where it makes a U-turn and is then sucked into the suction port 21. The convergence of this flow can be intensified by increasing the suction force relative to the strength of the blown air. This produces a corresponding convergence in the cavity 15 that is produced.

Any one of the arrangements of FIGS. 28, 31, 32 and 33 can be used to produce letters of the alphabet by forming cavities 15 with prescribed cross-sections by using the respective methods described in the foregoing and then charging the cavities formed in various sizes and shapes with the red particles 13' of the upper course 13. After the pattern is thus formed it is set into an integral mass, either as it is or after being smoothed or after also being overlaid with a backing course, if required.

The example of a shaped article patterned with a mountain scene produced from a photograph shown in FIG. 14 is formed using an air flow controller having both a suction port and a blow port. This pattern can be produced by employing any air flow controller equipped with variously configured suction port and blow port assemblies. However, for brevity the explanation will focus on the case where the cavities are formed using an air flow controller 20 equipped with the double pipe structure shown in FIG. 34, in which the suction port 21 is arranged within the blow port 28. This arrangement consists of a lower course 12 of white particles formed on a base surface 10 and overlaid by an upper course 13 of red particles, as shown in FIG. 2(*a*). FIG. 31(*a*) shows an example in which the blow port 28 and suction port 21 are positioned over the upper part of the upper course 13 and moved while air blown from the blow port 28 flows in a U-turn and is then sucked into the suction port 21, carrying with it particles removed from the upper and lower courses. This produces a prescribed cavity 15, into which upper course particles 13' are charged by raking or vibrating the particles, thereby forming the pattern of the photograph. The particle pattern thus formed is set into an integral mass, either as it is or after being smoothed or after also being overlaid with a backing course 16, if required.

Figure 35A:
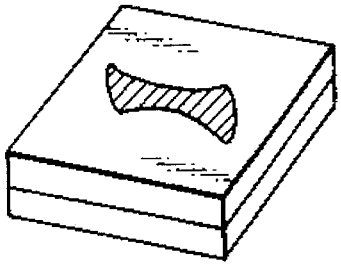
FIG. 35(*a*) is a perspective view showing a fifth example of a shaped article produced according to the invention.
Figure 35B:
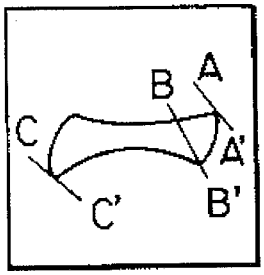
Figure 35C:
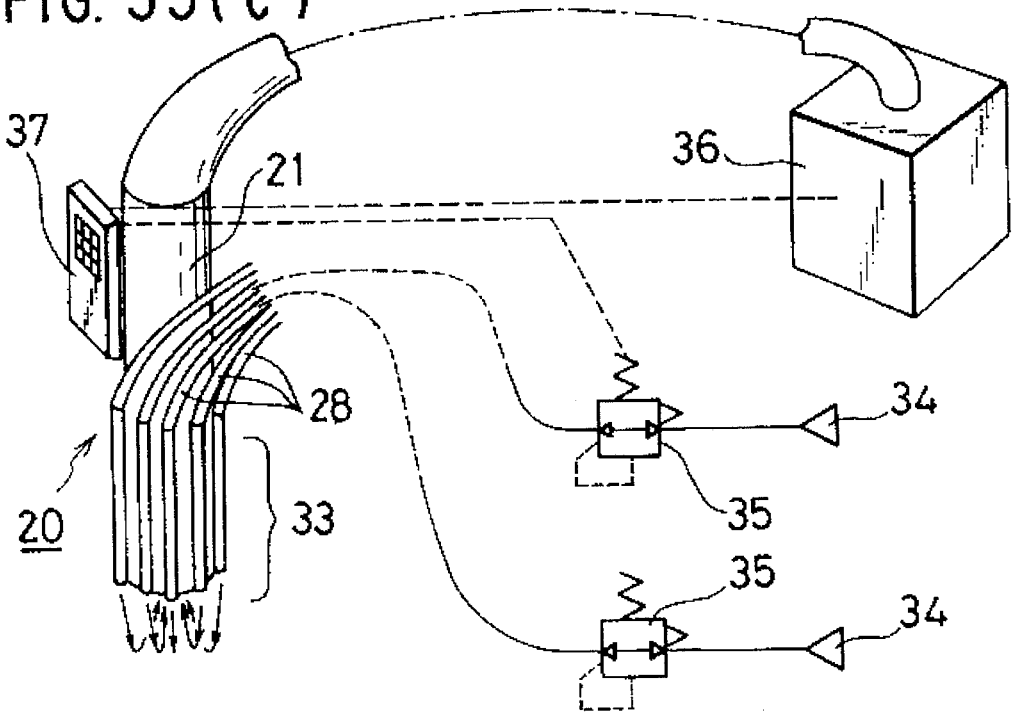
Figures 36A, 36B:
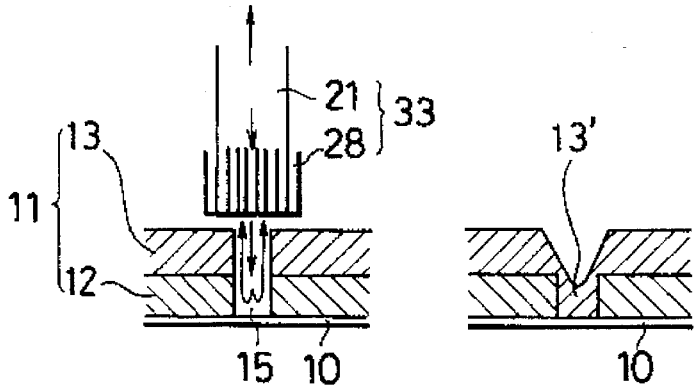
FIGS. 36(*a*) and 36(*b*) illustrate a sequence used to form the part of the pattern of the shaped article of FIG. 35(*b*) indicated by line A-A', using the apparatus of FIG. 35(*c*).
Figures 37A, 37B, 37C:
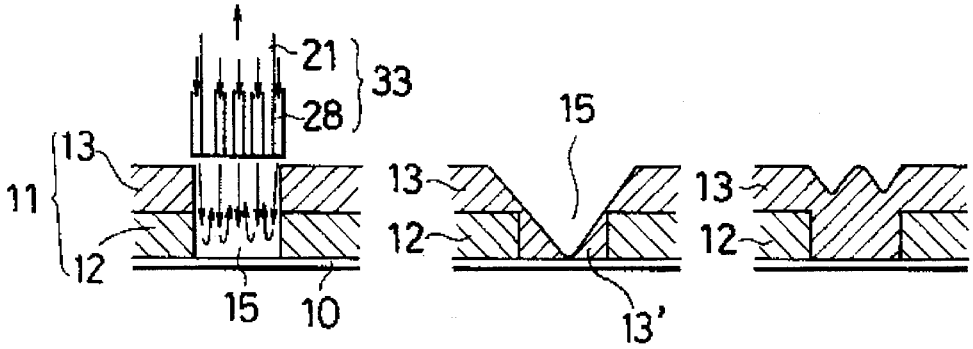
FIGS. 37(*a*) to 37(*c*) illustrate a sequence used to form the part of the pattern of the shaped article of FIG. 35(*b*) indicated by line B-B', using the apparatus of FIG. 35(*c*).
Figures 38A, 38B:
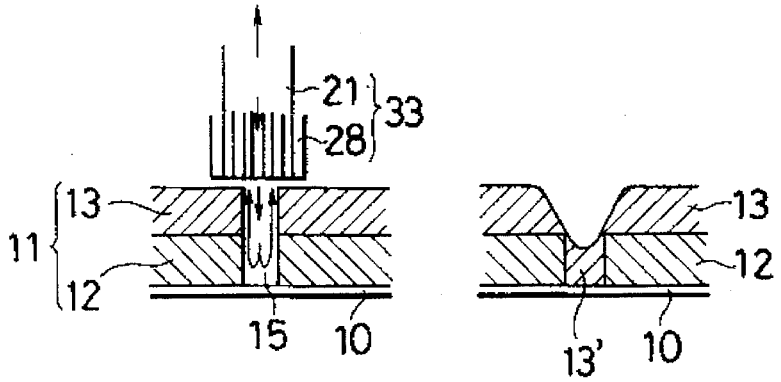
FIGS. 38(*a*) and 38(*b*) illustrate a sequence used to form the part of the pattern of the shaped article of FIG. 35(*b*) indicated by line C-C', using the apparatus of FIG. 35(*c*).

FIG. 35(*a*) shows an example of a shaped article patterned with a black brush-drawn character (the Chinese character for "1") in a white ground. In this case, the bottom surface is a black course formed of the same black particles used to form the character. This pattern is formed using the air flow controller 20 shown in FIG. 35(*c*). The air flow controller 20 is provided with blow/suction ports 33 constituted by twelve small blow ports 28 that are arranged around a suction port 21. The blow ports 28 are each connected to an air compressor 34 via individual control valves 35 and the suction port 21 is connected to a controllable aspirator 36. The control valves 35 and aspirator 36 are controlled by a microcomputer 37 disposed near the blow/suction ports 33. A composite course is formed consisting of a base surface on which is laid a white particle lower course 12, and an upper course 13 of black dry particles is laid on the lower course 12. As shown in FIG. 36, the blow/suction ports 33 are positioned over the upper course 13 at a prescribed point at which the pattern is to be started. To start with air blown from one blow port 28 is sucked, and the number of the blow ports being used is gradually increased one at a time to remove particles while the air flow controller is moved, as shown in FIG. 35(*b*), from A-A' to B-B'. At position B-B' particles are being sucked away using air blown by the six blow ports 28 on the rearward side, with respect to the direction of advance (FIG. 37). The advance continues toward C-C' while varying the number of blowing blow ports in accordance with the shape of the character. Character pattern cavity formation is finished at the C-C' portion, at which point particles are being removed using air blown from just one blow port, the frontmost one with respect to the direction of advance (FIG. 38). The cavity thus formed is charged with black particles 13' raked or vibrated from the upper course. Any part of the cavity that remains is charged using the same black particles as those of the upper course (FIG. 37). The particle pattern thus formed is set into an integral mass, either as it is or after being smoothed, or if required after being overlaid with a backing course 16. With respect to this arrangement, even finer patterns formed by delicate changes to the air flows can be produced by using an air flow controller configured so that the position and direction of each blow port can be freely changed.

Figure 39:
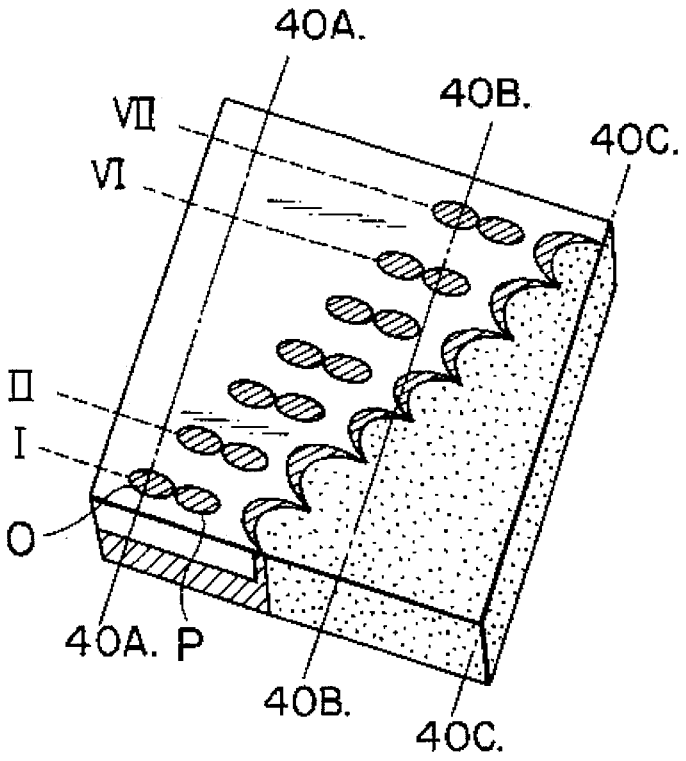
FIG. 39(*a*) is a perspective view showing a sixth example of a shaped article produced according to the invention.
Figure 39:
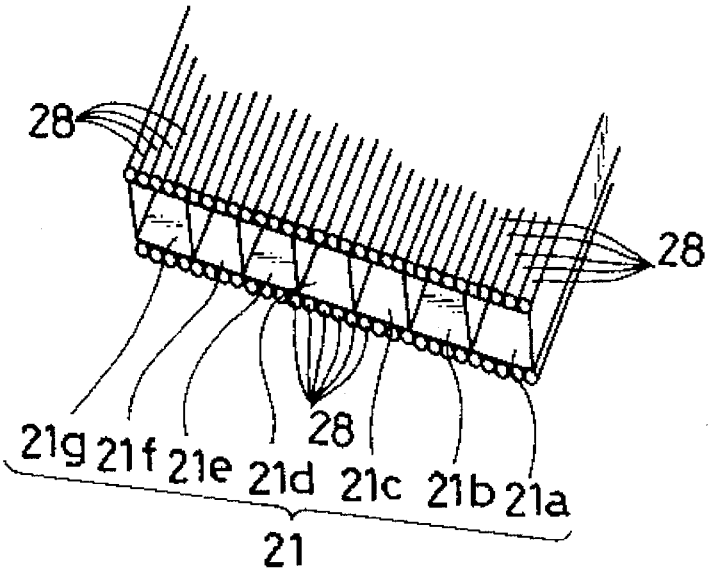
Figure 40A:
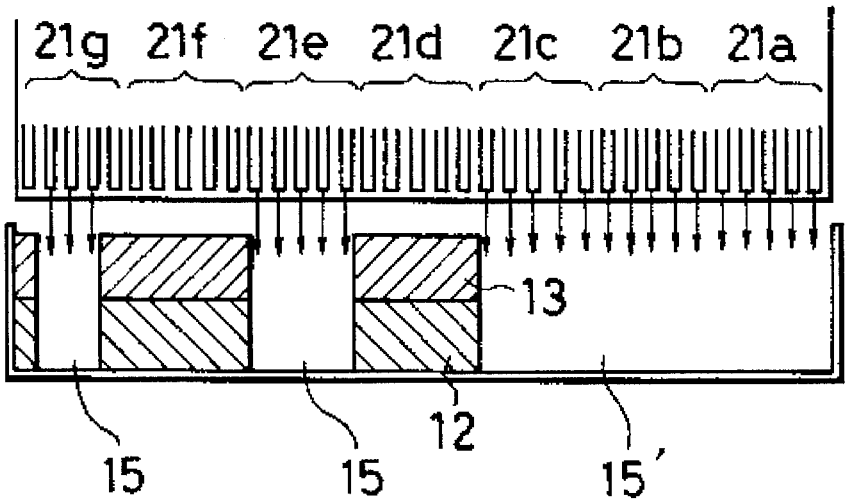
FIGS. 40(*a*) to 40(*c*) illustrate a sequence used to form the part of the pattern of the shaped article of FIG. 39(*a*) indicated by line B-B', using the apparatus of FIG. 39(*b*).
Figure 40B:
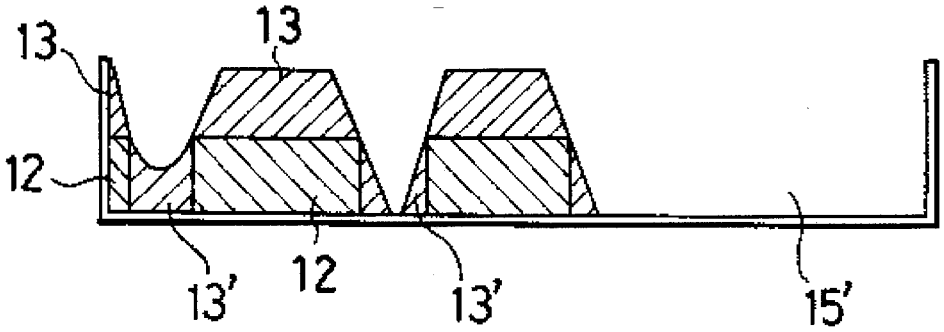
Figure 40C:
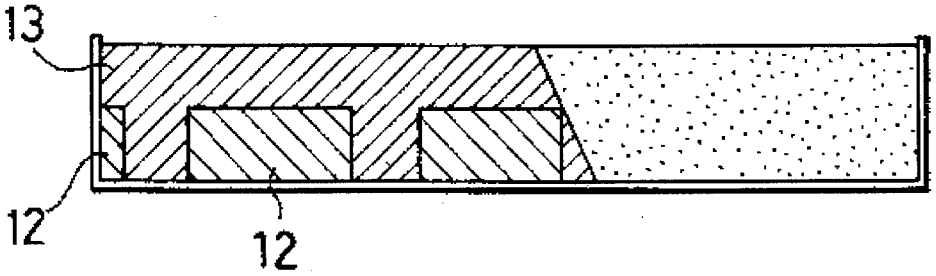

FIG. 39(*a*) shows a shaped article with a black and gold pattern depicting the tip of a bird's wing. This arrangement is constituted by a black bottom course formed with the same material used for the black wing tip, and contains a course of a gold material vertically connected in parts. This shaped article can be formed in accordance with the invention by using an air flow controller provided with seven suction ports 21*a* to 21*g* arranged in a line corresponding to the pattern, each of which is provided with five air blow ports 28 at each side, making a total of 35 blow ports per side, or 70 blow ports in all. Each of these 70 blow ports is individually connected to a pressure source via a control valve and each of the suction ports 21*a* to 21*g* is connected to an aspirator via a control valve. The blow/suction port assembly is supported by a multi-joint articulated robot, and the air flow controller has a computer that controls the control valves of the 70 blow ports and seven suction ports and the robot. A composite course is formed consisting of a white particle lower course 12 on a base surface, and an upper course 13 of black particles on the lower course 12. The blow/suction ports are positioned over the upper course 13 at a prescribed point (A-A') at which the pattern is to be started. First, suction port 21*a* corresponding to pattern row I is activated while at the same time activating the five blow ports 28 on the rear side of the suction port 21*a*, with respect to the direction of advance, whereby a cavity 15 is formed by particles from the upper and lower courses being entrained in the flow of air from the blow port being sucked into the suction port (FIG. 4). As the blow/suction ports advance from A-A' towards C-C', to form the pattern air is first blown from the center blow port, and then also from the blow port on either side of the center blow port for a total of three blow ports, then just from the center blow port, and then the center blow port is turned off. The cavity thus formed is charged with black particles raked or vibrated from the upper course, to thereby form the first black leaf-shaped pattern 0 of row I. To form the cavity for the next, slightly larger, leaf-shaped black pattern P, air is blown first from the center blow port, then the blow port at each side of the center blow port are added, and then all five blow ports are activated, then just the three center blow ports, then just the center port, and finally the center port is turned off. Patterns O and P of rows I to VII are arranged at a prescribed staggered pitch so that when the cavity for pattern O of row II is being formed midway through the formation of pattern O of row I, the suction ports and blow ports can be operated in the same way as for row II. Thus, with respect to line B-B' in FIG. 39(*a*) white and black particles are removed from the upper and lower courses by the suction and blow ports used for rows I, II and III, without activating the suction ports (21*d* and 21*f*) and blow ports used for pattern rows IV and VI. For row V, suction port 21*e* and five blow ports are operated for pattern P cavity formation. For row VII, suction port 21*g* and three blow ports are operated for pattern O cavity formation. The pattern O and P cavities are charged using black particles 13' raked from the upper course, and if these particles are insufficient, they are supplemented using the same type of black particles. The cavity 15' on the basal side of the wing is charged with golden particles to express the pattern. After the pattern is thus formed it is set into an integral mass, either as it is or after being smoothed or after being overlaid with a backing course 16, if required. With respect to this arrangement, even finer patterns formed by delicate changes to the air flows can be produced by using an air flow controller configured so that the position and direction of each blow port can be freely changed.

In any of the arrangements it is possible to produce various patterns by using any of variously configured air flow controllers and by varying at least one parameter among air pressure, air flow rate, air flow speed, air flow direction, air flow pulsation, air flow intermittence, suction port size, blow port size, suction port position and blow port position, and also by varying the method used to form more than two courses. Any type of pattern can be freely expressed in what ever way is desired.

In any of the arrangements, particle courses can be formed by various methods such as a squeegee type course forming method, or by using a sliding supply tank, or by using a supply tank with a slitted nozzle, or a rotary feeder, or by employing a dense cellular body, bristling body belt or the like.

For formation of more than two particle courses, the lower course in contact with the base surface can be formed by a squeegee type course forming method, a sliding supply tank method, a method using a supply tank with a slitted nozzle, a rotary feeder method, or a method using a dense cellular body or bristling body or the like. Also, the upper courses can be formed over part of a lower course, as shown in FIG. 2(*b*), or over the entire surface. Course formation over part of the area can be done by forming course portions beforehand at the required location, or this can be done immediately prior to particle removal. This partial course formation just prior to particle removal is preferably done using a particle supply port disposed near or integrally with the suction port or the blow port of the air flow controller. The apparatus is simple, can be used for continuous course formation and the arrangement can be readily automated, providing high productivity.

The suction related parameters adjusted for controlling the air flow include the size of the suction port, the vertical position of the suction port, the suction intensity (flow rate, flow speed and pressure), the intermittence or pulsation of the suction, the direction of the suction, the amount of swirling flow imparted by the suction, the positioning etc. of a skirt, and the size, length and shape of breathers. Blowing related parameters adjusted for controlling the air flow include the size of the blow port, the vertical position of the blow port, the blowing intensity (flow rate, flow speed and pressure), the intermittence or pulsation of the blowing, the amount of swirling flow imparted by the blowing, and the positioning etc. of a skirt. The pipe connecting the suction port with an aspirator and the pipe connecting the blow port with a compressor can be equipped with regulators and other types of control valves which can be controlled for controlling the flow of air outside the suction port and the blow port. Otherwise the control signals for the regulators and other control valves, the control signals for the aspirator, compressor and the like and the control signals for the positioning devices and the like can be integrally processed and managed in a computer or a distribution control system. This is preferable in that it enables cavities with regular sections, cavities with irregular sections, or any other type of cavity to be formed as desired.

The invention can be combined with various freely selectable control methods. It is possible to control only one type of controllable parameter or to control several types simultaneously. Various arrangements are possible in addition to those described in the foregoing.

A balance should preferably be established for making the air pressure against the wall of the cavity appropriately positive, and for ensuring formation of a hole or continuous groove-shaped cavity with vertical walls the pressure should be kept from becoming any more negative than necessary, although this also depends on the nature of the particles. In the case where blowing is conducted with the blow port positioned at the surface of the particle courses, for producing a fine and sharply defined cavity it is preferable not to conduct the blowing at a fixed pressure from the beginning but to begin it at a low pressure and then increase the pressure when the cavity being formed has been completed to a size and shape enabling its wall to resist pressure and when a U-turn course has been established by the air flow. The same overall process control should preferably also be implemented in the case where blowing and suction are conducted in combination since this ensures the formation of sharply formed cavities. When suction is used to impart a negative pressure, it is preferable in the case of forming dot-like cavities to conduct the processing in short, pulse-like periods because this prevents cavities falling in owing to inflow of surrounding air, and preferable in the case of linework to increase the speed of line formation because this minimizes the negative pressure applied at any one point.

In the case of linework, it is advantageous to position the suction port in front and the blow port back. This is because the wall in the direction of advance is broken down by the air blown from the blow port at the rear so that the formed cavity is under positive pressure and not unnecessarily subjected to negative pressure. As a result, a clean cavity can be formed with high efficiency. Similarly, in the case of using only suction it is preferable to form the line with the breather port, breather tube or other breather member positioned at the rear and the suction port positioned at the front so as not to expose the cavity to unnecessary negative pressure after it is formed.

The diameter of the individual suction ports or blow ports should preferably be not greater than twice the thickness of the particle courses. Fine blow and suction ports are preferable for the production of fine pattern features. A particularly sharply defined flow can be obtained by making the diameter of the blow port equal to or smaller than the thickness of the particle course. For obtaining well straightened air flows and ensuring formation of sharply defined cavities, it is further preferable for the suction port pipe, blow port pipe and breather tube to have lengths which are not less than three times their diameters. In view of the purpose of the skirt, it is preferably provided with a breather tube or breather tubes.

Figure 43A:
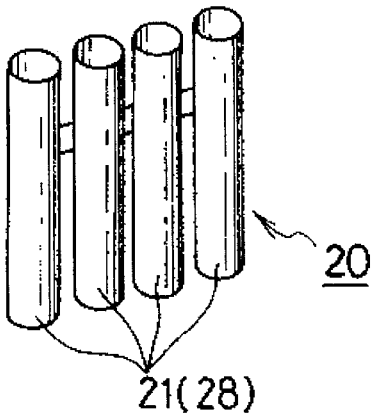
FIG. 43(*a*) is a perspective view showing multiple suction ports (blow ports) arranged in a line.
Figure 43B:
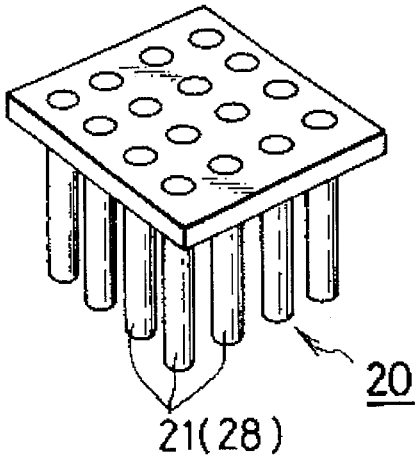
Figure 44A:
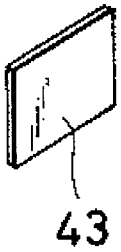
FIGS. 44(*a*) to 44(*g*) are perspective views of various end stops.
Figure 44B:
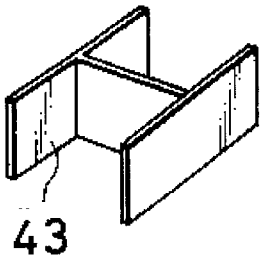
Figure 44C:
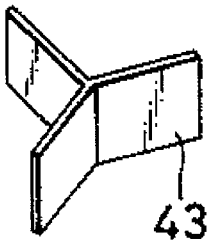
Figure 44D:
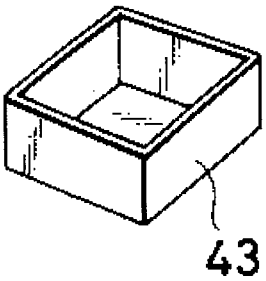
Figure 44E:
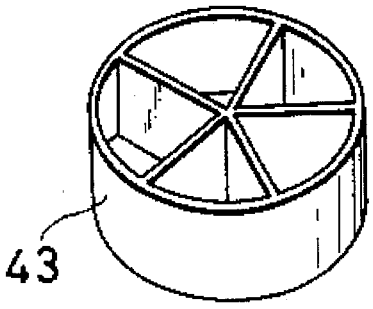
Figure 44F:
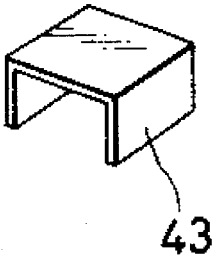
Figure 44G:
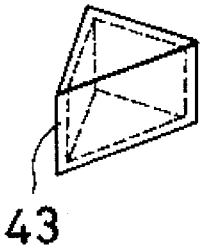

While a single suction port or blow port suffices, it is also possible to provide multiple ports arrayed linearly as shown in FIG. 39(*b*), or in a matrix. By making the arrayed ports controllable by a computer for direct pattern production, it is possible to achieve high productivity while enabling free pattern modification and the production of various complex and highly sophisticated patterns. When a pattern expresses a brush stroke such as in the case of the shaped article of FIG. 35(*a*), or as shown in FIG. 39(*a*) a color is gradually changed dot by dot until the color has been changed to a completely different color, producing a single pattern with a large area, patterns having complex outlines can be expressed neatly and easily by using suction or blowing to remove the entire central portion that has been charged and leave just the pattern outline portion. In such a case it is possible to use various combinations of suction ports and blow ports such as the multiple linear arrays of suction ports and blow ports shown in FIGS. 39(*b*) and 43(*a*), the arrangement of FIG. 35(*c*) in which one or more suction ports are arranged within a circle of multiple blow ports, or the configuration of FIG. 43(*b*) in which multiple suction ports and/or blow ports are arranged in a matrix.

Figure 10A:
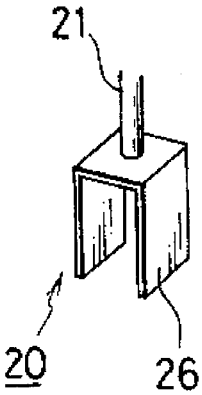
FIG. 10(*a*) is a perspective view showing a sixth example of a suction port.
Figure 10B:
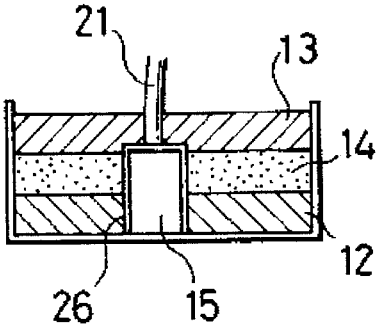
Figure 10C:
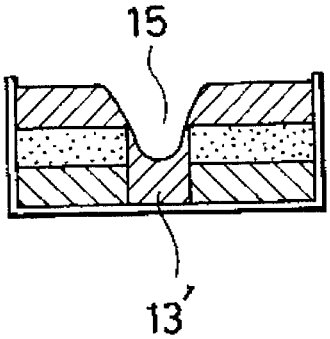

A skirt such as skirt 22 or 26 can be preferably used for various purposes such as for adjusting the size of the cavity formed, preventing inflow of surrounding air and thus enabling full utilization of the stress produced by the air flowing through the breather ports, and producing an air flow for the formation of an angle of repose. The skirt need not have the disk-like shape described in the foregoing but may be elliptical or triangular, or have a drooping configuration with a sectional shape like an inverted letter U, as shown in FIGS. 9 and 10. Moreover, it does not have to be formed using plates arranged in parallel or be flat, but may instead be a solid body and may be either soft or hard. In addition, the skirt may be attached directly to the suction port or the blow port or be attached so that the length of the suction pipe or the blow pipe can be adjusted by moving the skirt vertically.

Figure 41A:
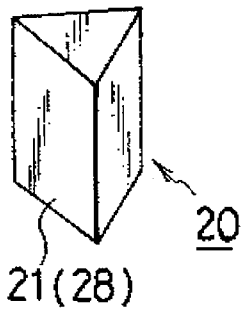
FIG. 41(*a*) is a perspective view showing a first example of a suction port (blow port).
Figure 41B:
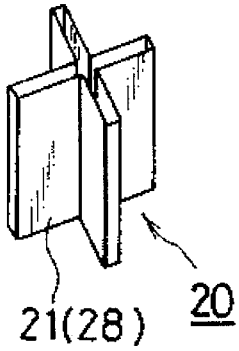
Figure 41C:
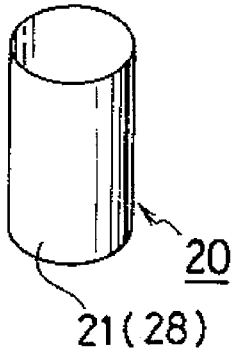
Figure 42:
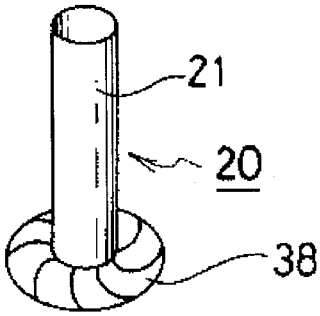
FIG. 42 is a perspective view showing a suction port fitted with a diaphragm.

As the material for the suction port, blow port, breather tube, skirt and the like there can be used, for example, metal, ceramic, plastic, rubber, paper, wood, unwoven fabric, woven fabric or the like. The shapes of the suction port, blow port, breather tube, skirt and the like can be freely selected. FIG. 41 shows some examples of the various shapes that can be used for the suction port and blow port. Examples of shapes that can be mentioned include square and triangular tubes and round and elliptical cylinders, or the ports can be configured for forming the individual dots as stars, hearts or any of various other shapes. Moreover, the suction port, blow port, breather tube, skirt and the like are preferably of a variable type. For example, arrangements that allow diameter, width, shape or the like to be varied can be used, such as the suction port fitted with a diaphragm 38 shown in FIG. 42, the extendible arrangements shown in FIG. 24 and the arrangement of FIG. 27(*c*) in which the blowing angle can be varied. When suction ports or blow ports are arranged in a line or matrix, the ports can be arranged so they can be folded back or raised to enable just the ports required to be used. Possible shapes, arrangements and structures are not limited to the above, but include various other shapes and configurations. Suction ports, blow ports, breather ports, skirts and the like and their support members can be made variable by forming them using shape memory metals or plastics that change shape when the temperature is varied. Moreover, when using an air flow controller having multiple blow ports, such as the one shown in FIGS. 35(*c*) and 39(*b*), it is preferable to configure the air flow controller so that the position and direction of each blow port can be freely changed to thereby make delicate adjustments to the air flow direction and position etc., enabling fine patterns to be formed.

Raking or vibration can be used for charging a cavity with upper course particles, both when the cavity to be filled is formed in the lower course and when the cavity is formed by removing particles from both the lower and upper courses. Preferably, filling a cavity formed by removing particles from both the upper and lower courses is done by affixing a vibrator or raking member 41 near or integrally with the suction port or the blow port of the air flow controller (FIGS. 2(*c*), 6(*c*) and 27(*c*)).

Use of the various end stops 43 shown in FIG. 44 at the beginning, end and junctions of the pattern ensures a neat finish to the shape at these points. The shapes of the end stops are not limited to those shown and may be varied as desired for obtaining various neatly finished start, junction and end point configurations. Preferably, the end pieces are built into the apparatus to be vertically movable in the vicinity of the suction port or blow port, so that they can be lowered for use when needed to protect start point, junction and end point configurations and ensure a neat finish.

As the base surface it is possible to use the bottom plate of a form or, alternatively, a sheet, belt, board or the like, the bottom plate of a double action or other type press, the bottom plate of a form placed on a conveyor, or a belt conveyor or other such endless surface. The particle course can be placed on a board, sheet or other such base surface either as it is or turned upside down. When selecting a base surface for use with an air flow controller, a base surface should be selected according to the article being shaped and how easily the base surface can be combined with the apparatus.

Although any type of material can be used for the base surface, it is preferable to use unwoven fabric, woven fabric, paper or the like. This is because the particles are able to fit into the irregularities of such materials and this has the effect of stabilizing the bottom surface of the particle course. It is also preferable that the unwoven fabric, woven fabric, paper or the like used for the base surface is gas-permeable, liquid-permeable, and also liquid-absorbent as this assists deaeration, thereby removing excess liquid and ensuring the shaped article is of uniform strength.

Figure 45:
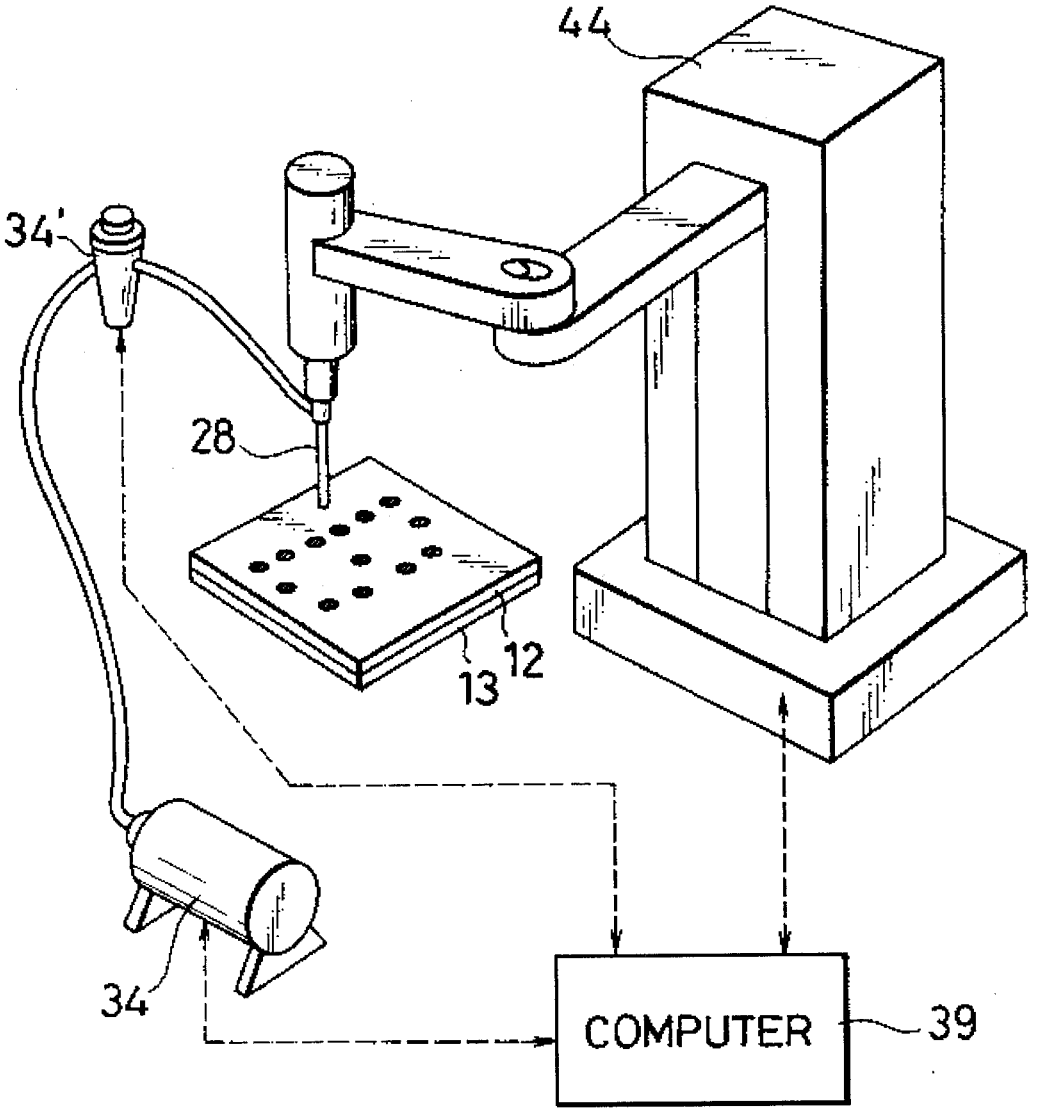
FIG. 45 is an illustration of dot pattern formation using a robot, computer and blow port.
Figure 46:
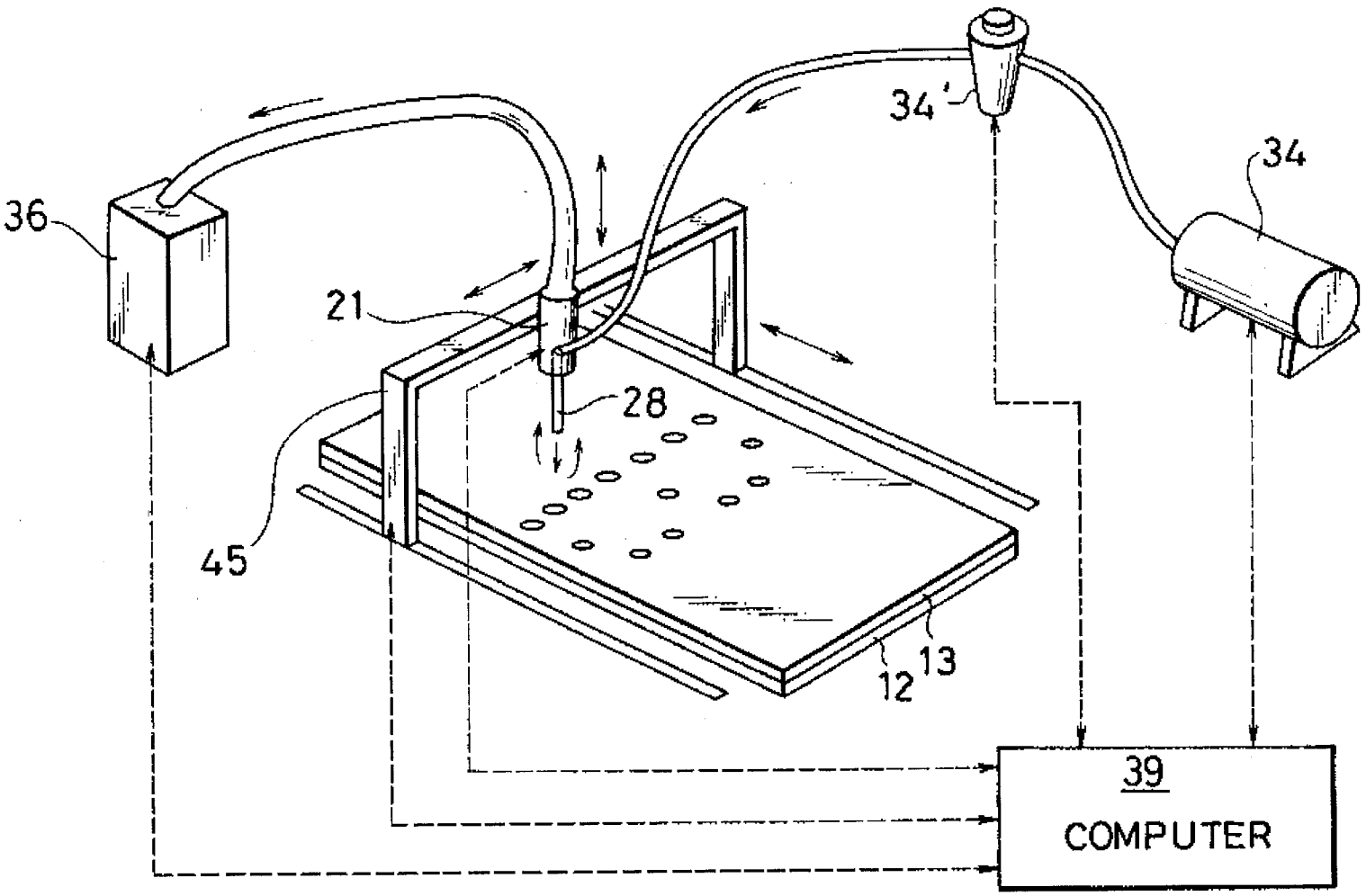
FIG. 46 is an illustration of dot pattern formation using a frame that is movable in the X and Y directions, a computer, and an air flow controller in which the suction port and blow port are a single assembly.

In any of the arrangements, the positioning of the suction port, blow port etc. in the X, Y and Z directions and the tilting of the suction port, blow port etc. can be controlled either manually or by use of any of various positioning mechanisms such as the robot 44 shown in FIG. 45 and the gate-shaped frame 45 shown in FIG. 46, or an XY table or the like. If required, moreover, the suction port, blow port etc. can be equipped with vibrators and various auxiliary devices, auxiliary members and the like.

That is to say, the computer 39 has each of the robot 44, gate-shaped frame 45, air compressor 34, regulator 34', suction device 36 and gate of the suction port 21 connected thereto to control the position of the robot 44 or gate-shaped frame 45, the direction and position of the suction port 21 and/or blow port 28, the pressure of the air compressor 34, the operation of the regulator 34' and the operation of the gate of the suction port 21.

In any of the arrangements, the free end of a particle course forming apparatus located at the boundary between a chute and a conveyor or the transfer section of a conveyance device can be used as the base surface, and the suction port and/or blow port can be located at this position for forming the cavities simultaneously with the course formation or the transfer operation. This method enables the production of endless patterns. A continuous color blender can be incorporated to supply differently colored materials for each course portion formed.

Any of the arrangements can be used in combination with various types of presses. For example, it is possible to use the press plate below a double action press as the base surface and, after a patterned shaped article has been formed on the press plate, to press it into a solid mass with the press. Moreover, since there is no need for contact with the particle course, it is also possible to use the roll surface of a roll press as the base surface. In addition, it is possible first to cause a plurality of patterned shaped articles to set as one large one and later cut them into individual articles.

In the case of any of the arrangements it is preferable to adjust the degree of falling-in of the particles, as the result is neater pattern formation. This can be done by appropriately processing the particles to control particle fluidity. Particle fluidity can for example be moderated by light compression of course particles. The degree of falling-in can also be adjusted by varying the particle size distribution, or by slightly moistening the particles.

Any type of particles can be used to fill any cavity that remains following the falling-in of the upper course. Thus, the same particles as those of the lower course or upper course can be used, or particles that are different from the upper or lower course particles. The particles can be selected according to the pattern to be expressed.

In each case, causing upper course particles to fall into a lower course cavity produces a cavity in the upper surface of the upper course. Particles can be used to fill this cavity and smooth the upper surface. In this case too, the same particles as those of the lower course or upper course can be used for this purpose, or particles that are different from the upper or lower course particles. The particles can be selected according to the pattern to be expressed.

In the method of the present invention, at least two kinds of dry particle materials are used for forming on the base surface two courses one on top of the other. Although the material is dry, it may have absorbed one or more of water, oil, lubricant-bonding agent, solvent, setting agent and plasticizer, if it is not kneaded with water, oil, lubricant-bonding agent, solvent, setting agent or plasticizer and is in a dry state readily amenable to pulverization for supply to the base surface. On the other hand, the material of which the backing layer is formed may be either dry or wet with one or more of water, oil, lubricant-bonding agent, solvent, setting agent and plasticizer.

In producing a concrete shaped article, the course material is dry and consists mainly of cement powder, resin or a mixture of cement powder and resin and may additionally include at least one of a pigment and fine aggregates. The material for a backing layer consists mainly of cement powder, resin or a mixture of cement powder and resin, the mixture further containing a fine aggregate and, if necessary, additionally containing a pigment and at least one of coarse aggregates and various kinds of fibers. The backing material may either be dry like the course material or in the form of a concrete slurry obtained by kneading with water etc.

Both the materials for the course and the material for the backing layer may additionally include wood chips as aggregates or fine aggregates and may further include as blended therewith crushed or pulverized granite, crushed or pulverized marble, slag, light-reflecting particles, inorganic hollow bodies such as Shirasu balloons, particles of ceramics, new ceramics, metal, ore or other substances. They may also contain as additives a congealing and curing promoter, a waterproofing agent, an inflating agent and the like. The aforementioned various kinds of usable fibers include metal fibers, carbon fibers, synthetic fibers, glass fibers and the like.

All the materials are supplied to a form etc. and are allowed to set into an integral mass. Otherwise after the material has been supplied, a prescribed amount of water is supplied to all portions of the interior of the form etc., thereby setting the materials into an integral mass within the form etc. If a wet material is used for the backing layer, the amount of water supplied is reduced in view of the water contained in the wet material. When a plate of metal, wood, cement, glass or ceramic or a sheet of paper, unwoven fabric, woven fabric or knit fabric is used as the backing layer, for example, it can be allowed to set integrally with the course. An asphaltic concrete shaped article can be produced using a thermal fusion material such as asphalt.

In producing an artificial stone shaped article, the materials for the course or the backing layer may, for example, be constituted of at least one of rock particles, ceramic particles, new ceramic particles, glass particles, plastic particles, wood chips and metal particles and may, as found necessary, further have mixed therewith a pigment etc.

A setting agent for setting the materials for the course and the backing layer is composed mainly of a mixture of cement powder and water, a mixture of cement powder, resin and water, a mixture of resin and water, a mixture of resin and solvent, or a mixture of resin, water and solvent and may further contain particles of at least one of rock, ceramic, new ceramic, glass and plastic and may, as found necessary, be kneaded with a pigment or colorant and have mixed therewith various kinds of particles, various kinds of fibers, various kinds of mixing agents and various kinds of additives. The various kinds of particles include particles of slag, fly ash and fine light-reflecting substances. The various kinds of fibers include metal fibers, carbon fibers, synthetic fibers and glass fibers. The various kinds of mixing agents and additives include shrink proofing agents, congealing and setting promoters, delaying agents, waterproofing agents, inflating agents, water reducing agents, fluidizing agents and the like.

For enhancing the adherence of the setting agent with the aforementioned materials, the materials can be sprayed with or immersed in water, solvent or surface treatment agent.

All the materials can be set into an integral mass within a form etc. by vacuum-suction treatment, centrifugal treatment or other such treatment for spreading the setting agent between adjacent particles or by using a mixture of an aggregate and a setting agent as the material for the backing layer. When a plate of metal, wood, cement, glass or ceramic or a sheet of paper, unwoven fabric, knit fabric, woven fabric or plastic is used as the backing layer, the course can be allowed to set integrally therewith.

For producing a ceramic shaped article or the raw product for a ceramic shaped article, the dry materials for the course are mainly particles of one or more of clay, rock, glass, new ceramic, fine ceramic and glaze with or without a pigment or colorant added thereto. Although the materials are dry, they may be ones which have absorbed some water or been added with a lubricant-bonding agent if they are not kneaded with the lubricant-bonding agent or water and are in a state readily amenable to pulverization. The material for the backing layer is constituted mainly of particles of one or more of clay, rock, glass, new ceramic and fine ceramic and may additionally contain a pigment and a colorant. In the finished state, the backing layer is required to differ from the course in color, luster, texture and the like and may be either dry, similarly to the course, or made wet by kneading with water or a lubricant-bonding agent. In addition, either the materials for the course or the material for the backing layer may have further mixed therewith inorganic hollow bodies such as Shirasu balloons, and particles of ceramic, metal or ore and may have added thereto various kinds of foaming agents, fluidization-preventing agents, supernatant agents, lubricating agents, bonding agents and adherence promoters as additives.

The materials supplied into a form etc. are allowed or caused to set into an integral mass without adding or by adding a predetermined amount of water or lubricant-bonding agent to plasticize them and applying pressure to the resultant mixture. The set integral mass is removed from the form etc. and used as a raw product. The raw product is sintered to obtain a ceramic shaped article. Otherwise, the materials supplied into a refractory setter or similar form are melted or fused by heating to obtain an integral mass, and the integral mass is removed from the setter. In the case of a shaped article of enamel, stained glass or crystalline glass the material for the course is laid on a plate of metal, glass or ceramic, and melted or fused by heating to be made integral with the plate.

In producing a raw product to be sintered into a metal shaped article, the dry materials for the course are mainly particles of one or more of metals and alloys and may, as found necessary, further have mixed therewith a lubricant. Although the materials are dry, they may be ones which have absorbed the lubricant if they are not kneaded with the lubricant and are in a state readily amenable to pulverization. The materials for the backing layer are constituted mainly of particles of one or more of metals and alloys and may be either dry or made wet by kneading with a lubricant.

Examples of the lubricant used herein include zinc stearate and other lubricants. The dry materials for the course or the materials for the backing layer may further contain a bonding agent and other additives.

All the materials are supplied into a main form etc., pressed therein and removed therefrom to obtain the raw product for a metal shaped article. The raw material is sintered into a metal shaped article. A metal shaped article may be produced by supplying all the materials onto a sheet of metal, glass, ceramic, etc, applying pressure to the resultant composite to obtain an integral mass of raw product, and sintering the integral mass.

The dry materials for the course used in producing a shaped article having an impasto layer are various kinds of powdered paint, and the material for the backing layer is a plate, sheet or the like of metal, wood, cement or ceramic. The various kinds of powdered paint include acrylic resin, polyester resin, acrylic-polyester hybrid resin, fluorine resin and similar resins having a pigment or colorant added thereto. The materials for the course are laid on the plate, sheet, etc. as a backing layer, melted and fused by heating and baked to unite all the layers together. In uniting all the layers together, pressure may be applied to the layers. As a result, it is possible to obtain a plate, sheet, etc. having an impasto layer thereon.

In producing a plastic shaped article, the dry materials for the course are constituted mainly of particles of various kinds of plastics and may additionally contain a pigment or a colorant. The materials may also contain a plasticizer or solvent, but are not kneaded with a plasticizer or solvent and are in a state readily amenable to pulverization. The material for the backing layer may be either dry or made wet by kneading with a plasticizer or solvent. The various kinds of plastics include polyethylene, nylon, polypropylene, polycarbonate, acetal, polystyrene, epoxy, vinyl chloride, natural rubber, synthetic rubber, acrylonitrile-butadiene-styrene, polypropylene oxide, ethylene-vinyl acetate copolymer, fluorine resin and other thermoplastics and thermosetting resins. Both the materials for the course and the material for the backing layer may, as found necessary, contain a foaming agent, oxidization preventing agent, thermal stabilizer, bridging agent, other additives and particles of inorganic materials and the like. All the materials are melted or fused into an integral mass by heating, while applying pressure thereto, if necessary. With this method, it is possible to produce a patterned shaped article of foamed styrol, a patterned shaped bathtub or floor tiles of plastic, etc. In this case, the layers may be united with a plate of metal, wood, cement, ceramic or a sheet of paper, unwoven fabric, knit fabric, woven fabric or plastic.

In producing confectionery or other shaped foodstuffs, the dry materials for the course are constituted mainly of particles of one or more of wheat, rice, potato, bean, corn and sugar and may additionally contain seasonings and spices. The materials may also contain oil, water, etc., but are not kneaded with oil, water, etc. and are in a state readily amenable to pulverization. The material for the backing layer may be either dry, similarly to the materials for the course, or made wet by kneading with oil, water, etc. Both the materials for the course and the material for the backing layer may, as found necessary, further contain an inflating agent and other additives. All the materials are supplied into a form etc. and are allowed to set or caused to set without adding or by adding water, oil, etc. to plasticize them into an integral mass. The integral mass is pressed and then removed from the form, etc. to obtain a raw product. The raw product is then baked. Otherwise, all the materials are baked within the form etc. With this method, it is possible to produce various patterned baked confectioneries etc. It is also possible to produce a patterned shaped article melted by heating, such as a patterned chocolate shaped article etc., by using particles of the material melted by heating, such as chocolate etc., and melting and fusing the particles by heating.

The materials that can be used in the present invention are not limited to those set out as examples herein and various other materials can also be used depending on the shaped article to be produced. Moreover, the range of patterned shaped articles that can be produced can be increased by combining various materials that, in the finished state, differ in property, color, luster, texture and the like. When molding sand and metal powder used as the materials, a molded casing and a patterned sintered metal can be produced.

In the method for producing any of the patterned shaped articles, it is desirable to apply vibration when the materials are supplied onto the base surface so as to ensure smooth movement of the materials. Further, by rubbing with a brush or comb or applying a jet of air or water to the boundary portion between the different kinds of materials for the course, the pattern can be blurred.

In addition, by providing on the base surface or material course a mat of unwoven fabric, paper or other water or oil absorbing material, any excess amount of water, oil, lubricant-bonding agent, plasticizer or solvent can be supplied to any portion deficient in them to uniformly disperse them in the shaped article. As a result, the ratio of the water (auxiliary agents) in the surface to the cement (resins) becomes small and this means that the strength of the shaped article as a whole is enhanced. When an air permeable mat is used in the formation of an article under pressure, degassing is enhanced to obtain a dense article. By vibrating or pressing one or both of the material course and the backing layer when the two layers are being allowed to set into an integral article, the integral article obtained becomes dense and is improved in strength. The article may be reinforced with long fibers, short fibers, wire nets or reinforcing rods by inserting these in or between the two layers. The method of using an article obtained by the sheet making method or extrusion molding method or any of various plates or sheets as the backing layer is applicable to the production of various articles including architectural panels and boards, wall sheets and tiles. The surface of an existing concrete article can be used as the base surface. In this case, the materials for the material course are discharged onto the concrete surface and set to be integral with the existing concrete article.

The invention makes it possible to express photographed image in the form of dots or lines without using an auxiliary form, cell body, bristling body or any other such divider or partition member. Moreover, since dots and lines of differing size and shape can be freely produced without inserting a suction port or blow port into the particle course, it is possible to use high-speed scanning in pattern production. In addition, since the material of the background portion and the material of the pattern portion are both laid on the base surface in advance so that individual charging for each pattern is not required, the amount of charging work etc. involved is greatly reduced and the productivity is enhanced. In addition, charging the formed cavity is easily accomplished using vibration or by raking the particles of the upper course. Since the invention does not require the use of auxiliary frames, cell bodies, bristling bodies or the like as dividers or partition members, the peculiarities of such members, such as the hexagonal patterning produced by a honeycomb partition member, for example, do not show up in the product, thereby enabling the patterns to be expressed more naturally. The invention is thus able to produce patterns resembling handwriting and when used to make sidewalk or pavement tiles patterned with maps, directions or the like is able to produce a product that is resistant to abrasion and pleasing to the eye.

As another of its effects, the invention enables formation of cavity patterns in randomly blended particle courses and, as such, makes it possible to produce patterns within a variegated background. Further, in the case of centrifuged concrete, since the particle course can be formed first and the cavities can be formed and charged to produce the pattern thereafter and, moreover, the formation and charging of the cavities can be conducted from the surface of the course, the pattern can be easily produced even during high-speed rotation. In addition, since, by dint of its operating principle, the invention permits patterning of a particle course irrespective of its size, it can be applied in conjunction with an endless conveyor or the like for simple production of continuous patterned shaped articles.

Patterns can be directly produced from a computer, providing high production efficiency and the ability to modify the patterns at will. By controlling at least one parameter among the air pressure, air flow rate, air flow speed, air flow direction, shape described by the flow of air, air flow pulsation, air flow intermittence, suction port size, blow port size, suction port position and blow port position, it is possible to produce the subtle differences in the air flow needed for forming finely configured cavities and thus to produce patterned shaped articles with various complex and sophisticated patterns, at high speed.

These production methods make it possible to easily produce concrete shaped articles, artificial stone shaped articles, raw products for sintering into ceramic shaped articles, ceramic shaped articles, metal shaped articles, impasto shaped articles, plastic shaped articles and shaped foodstuffs including confectionery each having a pattern of a prescribed thickness formed on part or all of the surface thereof. Therefore, the patterned shaped articles can maintain their patterns in excellent condition even when exposed to surface abrasion. Since the pattern layer is formed by a combination of various kinds of dry materials, the materials can, owing to their cave-in action, be densely charged without any gaps and the boundaries between adjacent materials can be minutely expressed. The pattern formed is thus very clear-cut.

What is claimed is:

1. A method of producing a patterned shaped article, the method comprising the steps of:

forming a lower course of dry particles on a base surface;

forming on at least part of the lower course at least one upper course of dry particles different in kind from those of the lower course, one on top of the other when two upper courses exist or one on top of another when three or more upper courses exist, the dry particles of the upper courses being different in kind from each other when two or more upper courses exist;

using an air flow controller having either a suction port or a blow port or both a suction port and a blow port to effect an air flow to form a cavity in the lower course by removing a portion of the lower course under control of at least one parameter among air pressure, air flow rate, air flow speed, air flow direction, air flow pulsation, air flow intermittence, suction prot size, blow port size, suction port position and blow port position;

collapsing specific dry particles, which make up the upper course when one upper course exists or which make up one of the upper courses when two or more upper courses exist, into the cavity; and setting all of the dry particles into an integral mass.

2. A method according to claim 1, wherein an upper surface of an uppermost upper course is smoothed before all the dry particles are set into an integral mass.

3. A method of producing a patterned shaped article according to claim 2, further comprising the step of providing on the upper surface after the upper surface has been smoothed a backing layer to be integral with the dry particles.

4. A method according to claim 1, wherein dry particles different in kind from those of the lower and upper courses are supplied to the cavity before all the particles are set into an integral mass.

5. A method of producing a patterned shaped article according to claim 4, further comprising the step of providing on the upper surface after the different dry particles have been supplied to the cavity a backing layer to be integral with the dry particles.

6. A method of producing a patterned shaped article according to claim 1, further comprising the steps of supplying the same dry particles as the dry particles of the upper course into a cavity formed in the upper course in consequence of the dry particles of the upper course collapsed into the cavity in the lower course, smoothing an upper surface of the upper course and setting all the dry particles into an integral mass.

7. A method of producing a patterned shaped article according to claim 6, further comprising the step of providing on the upper surface after the upper surface has been smoothed a backing layer to be integral with the dry particles.

8. A method of producing a patterned shaped article according to claim 7, wherein dry particles of the upper course are collapsed into the cavity, a backing layer is provided and the dry particles are set into an integral mass.

* * * * *